US012660891B2

(12) United States Patent
Kishimoto et al.

(10) Patent No.: US 12,660,891 B2
(45) Date of Patent: Jun. 23, 2026

(54) MEASUREMENT DEVICE FOR SHOE FITTING EVALUATION AND METHOD FOR SHOE FITTING EVALUATION

(71) Applicant: ASICS CORPORATION, Kobe (JP)

(72) Inventors: Ken Kishimoto, Kobe (JP); Naoko Matsumoto, Kobe (JP); Aya Yoshimura, Kobe (JP); Kei Kanematsu, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 18/365,174

(22) Filed: Aug. 3, 2023

(65) Prior Publication Data

US 2024/0041165 A1 Feb. 8, 2024

(30) Foreign Application Priority Data

Aug. 4, 2022 (JP) ..... 2022-124866

(51) Int. Cl.
*A43D 1/02* (2006.01)
*A43D 1/04* (2006.01)
*A43D 3/02* (2006.01)

(52) U.S. Cl.
CPC ..... *A43D 1/027* (2013.01); *A43D 1/04* (2013.01); *A43D 3/023* (2013.01); *A43D 3/025* (2013.01)

(58) Field of Classification Search
CPC . A43D 1/02; A43D 1/06; A43D 1/027; A43D 1/04; A43D 3/023; A43D 3/025
See application file for complete search history.

(56) References Cited

U.S. PATENT DOCUMENTS

| | | | | |
|---|---|---|---|---|
| 1,791,948 A * | 2/1931 | Bliss | A43D 1/06 33/3 A |
| 2,043,649 A * | 6/1936 | Bliss | A43D 1/06 33/3 A |
| 6,192,593 B1 * | 2/2001 | Borchers | A43D 1/06 33/542.1 |
| 2020/0069000 A1 * | 3/2020 | Bishoff | A43D 1/027 |
| 2021/0116235 A1 * | 4/2021 | Gray | A43D 1/027 |

FOREIGN PATENT DOCUMENTS

| | | | |
|---|---|---|---|
| DE | 102019110874 A1 * | 10/2020 | A43D 3/02 |
| EP | 3154388 B1 * | 8/2019 | A43D 1/06 |
| FR | 3002119 A1 * | 8/2014 | A43D 1/025 |
| JP | 2000-125909 A | 5/2000 | |

* cited by examiner

*Primary Examiner* — Aiying Zhao
(74) *Attorney, Agent, or Firm* — Studebaker Brackett PLLC

(57) ABSTRACT

A measurement device for shoe fitting evaluation is disclosed. The measurement device for shoe fitting evaluation includes a last insertable into a shoe, a pressure measurement unit configured to measure a wearing pressure on a top surface of a foot of the last, and a gap measurement unit configured to measure a gap between an end portion of the last and an end portion of the shoe. The last includes a main body portion and a variable portion. The variable portion is changeable in its shape, its weight, or its position with respect to the main body portion.

5 Claims, 21 Drawing Sheets

MEASUREMENT DEVICE FOR SHOE FITTING EVALUATION AND METHOD FOR SHOE FITTING EVALUATION

BACKGROUND

1. Technical Field

The present disclosure relates to a measurement device for fitting evaluation and a method for fitting evaluation used to evaluate a fitting of a shoe when a wearer wears the shoe.

2. Description of the Related Art

JP 2000-125909 A indicates a shoe inspection device having a last and a pressure measurement element provided on a surface portion of the last. Such an inspection device can insert the last provided with the pressure measurement element into a shoe and measure a contact pressure between the shoe and the last.

SUMMARY

In one embodiment, a measurement device for shoe fitting evaluation and a method for shoe fitting evaluation capable of appropriately evaluating the fitting of a shoe when a wearer actually wears the shoe is provided.

For example, a shape of the foot when the wearer is standing posture is often not the same as a shape of the foot when the wearer is walking. In addition, it is considered that in many cases, a wearing pressure on the foot when the wearer is standing posture is not the same as a wearing pressure on the foot when the wearer is walking. Therefore, even if a last representing a foot of a wearer standing posture is manufactured and a wearing pressure on a shoe is measured using the last, fitting when the wearer actually wears the shoe and is active cannot be appropriately evaluated.

A feature of the embodiment is that, in measuring the wearing pressure using the last, the fitting of the shoe can be appropriately evaluated by changing the last or by applying a load to the last in consideration of the actual movement of the foot.

A measurement device according to a preferred embodiment includes a last insertable into a shoe; a pressure measurement unit configured to measure a wearing pressure on a top surface of a foot of the last in a state where the last is inserted into the shoe; and a gap measurement unit configured to measure at least one of a gap between a front end portion of the last and an inner front end portion of the shoe and a gap between a rear end portion of the last and an inner rear end portion of the shoe, in which the last includes a main body portion and a variable portion, and at least one selected from a shape of the variable portion, a weight of the variable portion, and a position of the variable portion with respect to the main body portion is changeable.

A method for shoe fitting evaluation according to a preferred embodiment includes inserting a last into a shoe; and measuring a wearing pressure on a top surface of a foot of the last, in which the last includes a main body portion and a variable portion, at least one selected from a shape of the variable portion, a weight of the variable portion, and a position of the variable portion with respect to the main body portion being changeable, and the measuring is performed before changing the variable portion, while changing the variable portion, or after changing the variable portion.

DETAILED DESCRIPTION

Hereinafter, some embodiments will be described with reference to the drawings as appropriate. In the present description, "substantially" means a range acceptable in the technical field to which the present invention belongs. It should be noted that dimensions such as thickness and size in each drawing may be different from actual dimensions.

[Overview of Measurement Device]

A measurement device includes a last that is insertable into and removable from a shoe, a pressure measurement unit that measures a wearing pressure of a top surface of a foot of the last on the shoe, and a gap measurement unit that measures a gap between the shoe and the last.

The shoe is not particularly limited as long as it has a sole and an upper. Note that the sole is a constituent member disposed under the bottom surface of the foot of the wearer. The upper is a constituent member of the shoe excluding the sole and in contact with the top surface of the foot of the wearer.

The pressure measurement unit measures at least the wearing pressure on the top surface of the foot of the last in a state where the last is inserted into the shoe (in a state where the shoe is worn by the last). The top surface of the foot of the last refers to a surface region in contact with an upper inner surface of the shoe with the last inserted into the shoe. That is, the pressure measurement unit measures the wearing pressure on the last from the upper of the shoe in a state where the shoe is worn by the last. If necessary, the pressure measurement unit may include a unit measures the wearing pressure on the bottom surface of the foot of the last. The bottom surface of the foot of the last refers to a surface region in contact with the top surface of the sole of the shoe with the last inserted into the shoe. It can be said that the surface region of the last is formed of the top surface of the foot of the last and the bottom surface of the foot of the last, and the top surface of the foot of the last is a surface region excluding the bottom surface of the foot of the last.

The gap measurement unit measures at least one of a gap between a front end portion of the last and an inner front end portion of the shoe and a gap between a rear end portion of the last and an inner rear end portion of the shoe in a state where the last is inserted into the shoe.

One preferable aspect of the measurement device is that the last has a variable portion in which at least one selected from a shape thereof, a weight thereof, and a position thereof is changeable. Another preferable aspect of the measurement device is that it has a load application unit that applies a load to the last.

<Last>

Figure 1:
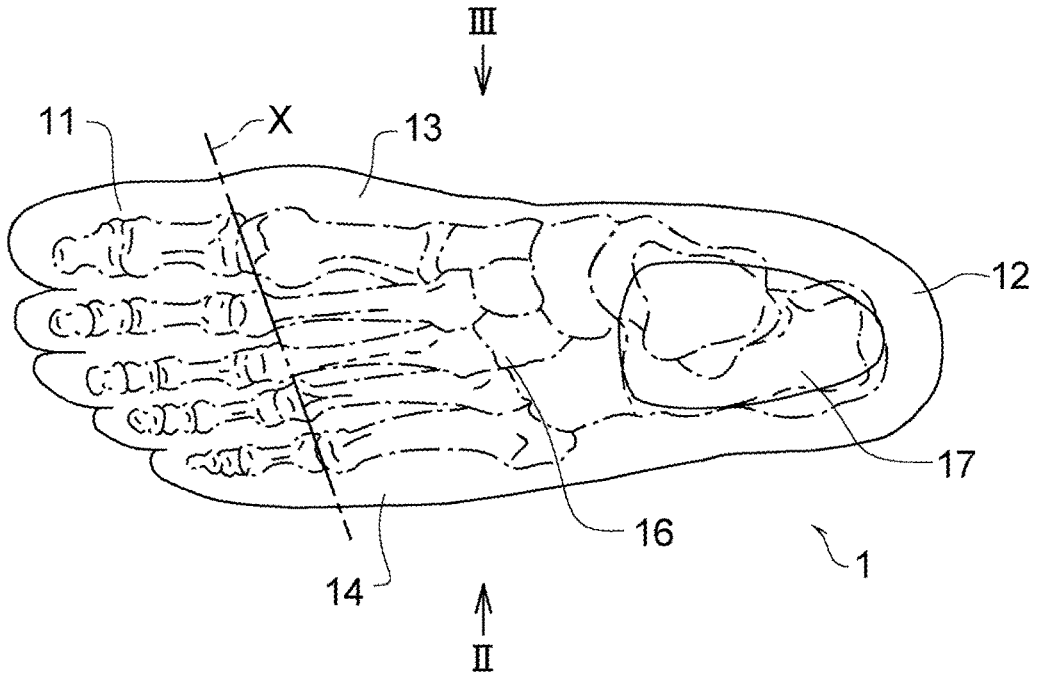
FIG. 1 is a top view illustrating an outer shape of a last.
Figure 2:
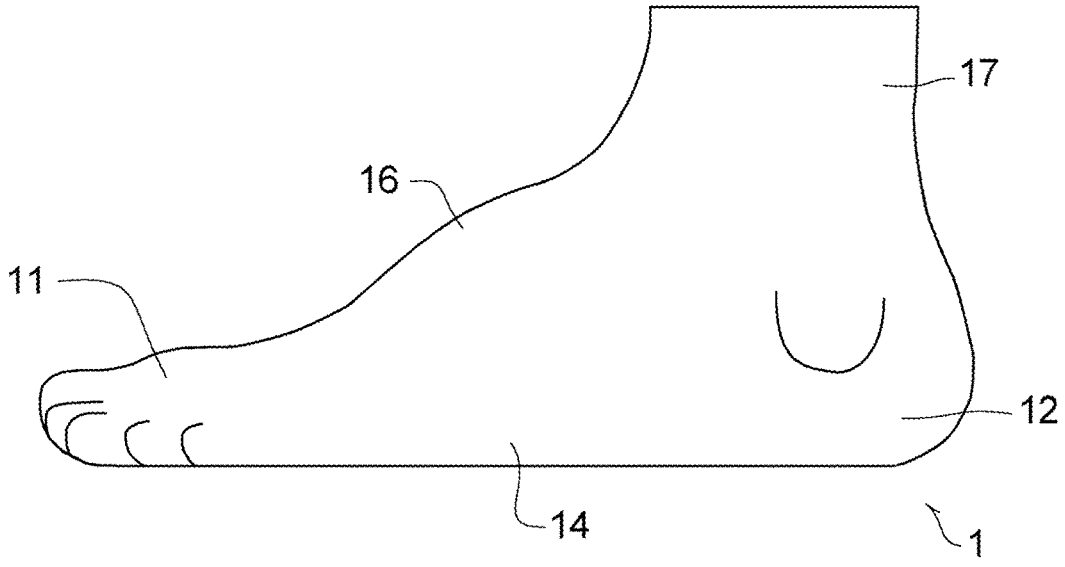
FIG. 2 is a left side view of the same.
Figure 3:
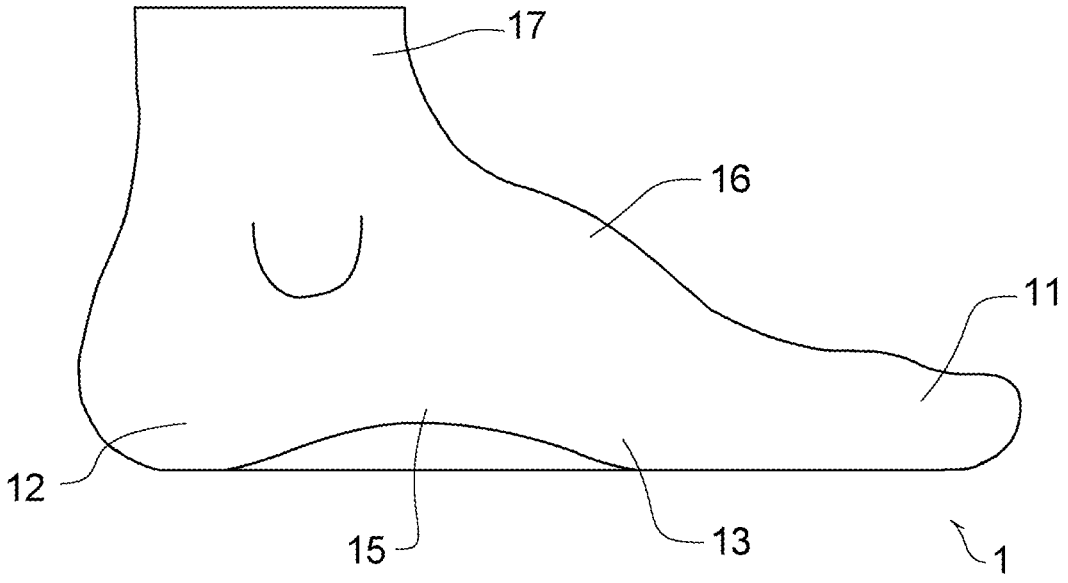
FIG. 3 is a right side view of the same.

FIGS. 1 to 3 are drawings illustrating an outer shape of a last 1. FIG. 1 includes a foot skeleton referred to for describing each part of the last 1. Note that the actual last 1 does not have a foot skeleton. The foot skeleton is represented by dot-dash lines which are virtual lines. FIG. 2 is a left side view of the last 1 as viewed from a direction of arrow II in FIG. 1, and FIG. 3 is a right side view of the last 1 as viewed from a direction of arrow III in FIG. 1.

The last 1 has an outer shape that substantially represents the outer shape of a person's foot. The last 1 in the illustrated example represents a left foot, but may represent a right foot. The last 1 can be manufactured by a method such as cutting, a 3D printing technique, or molding using a human foot or a shape similar to a human foot as a model. The last 1 may be manufactured by integrally molding the whole. Alternatively, the last 1 can also be manufactured by manufacturing some components and joining the components using an affixing agent such as an adhesive or an adhesive tape, a tightening material such as a screw, or the like, or by joining the components by a concave-convex fitting or the like. Regarding the last 1 manufactured by joining several components, some components may be joined in a detachable state.

The material for forming the last 1 is not particularly limited, and conventionally known soft materials or hard materials can be used. The soft materials differ from the hard materials in that the former is easily deformable when subjected to a force. Examples of the soft materials include soft resins, rubber, thermoplastic elastomer, and foams thereof. Examples of the hard materials include hard resins, metals, and wood. Since the last 1 can be formed having a tactile sensation close to that of a human foot, the last 1 is preferably formed of a soft material. For example, when defined by hardness, a soft material having a hardness in the type C hardness test of 20 or more and 80 or less is preferably used, a soft material having a hardness of 25 or more and 75 or less is more preferably used, and a soft material having a hardness of 30 or more and 70 or less is even more preferably used. The hardness in the type C hardness test can be measured according to the method described in JIS K 7312 using a spring hardness tester.

The last 1 has a main body portion and a variable portion provided in the main body portion. The variable portion is a part of the last 1 that can change at least one selected from its shape, its weight, and its position with respect to the main body portion. The main body portion is a part obtained by removing the variable portion from the last 1. The main body portion is a substantially invariable part. Note that the meaning of "substantially invariable" includes, for example, a case where a main body portion formed of a soft material is deformed by being pressed, but returns to its original state after the pressure is released.

The variable portion can be disposed in various parts of the last 1. For example, the variable portion can be disposed at a front portion 11, a rear portion 12, side portions including an inner side portion 13 and an outer side portion 14, an arch of a foot portion 15, an instep portion 16, an ankle portion 17, or the like of the last 1.

In FIG. 1, the human foot skeleton is superimposed on the last. As described above, in the illustrated example, since the last 1 representing the shape of a left foot is illustrated, the upper side of the drawing of FIG. 1 is the inside of the left foot (of the last), and the lower side of the drawing is the outside of the left foot (of the last). When the part where the variable portion is provided is described in relation to the foot skeleton, the front portion 11 of the last refers to a site in front of a virtual straight line X passing through each MP joint of the big toe and the little toe, the rear portion 12 of the last refers to a site corresponding to the heel bone, the inner side portion 13 of the side portion of the last refers to a site on the side of the first metatarsal, the outer side portion 14 of the side portion of the last refers to a site on the side of the fifth metatarsal, the arch of the foot portion 15 of the last refers to a site corresponding to the medial longitudinal arch, the instep portion 16 of the last refers to a site corresponding to between the MP joint and the Chopart joint, and the ankle portion 17 of the last refers to a site above the talocrural joint.

{Lasts and Load Application Unit Having Variable Portion Capable of Changing Position}

In this section, some lasts provided with a variable portion whose position with respect to a main body portion is changeable will be described as examples. Hereinafter, the variable portion whose position with respect to a main body portion is changeable may be referred to as a "position variable portion".

The position variable portion is not particularly limited as long as it is a part of the last. The position variable portion can be disposed, for example, at the front portion 11, the rear portion 12, side portions including the inner side portion 13 and the outer side portion 14, the arch of the foot portion 15, the instep portion 16, the ankle portion 17, or the like of the last. The mechanism for changing the position variable portion is not particularly limited, and various mechanisms can be adopted.

Figure 4:
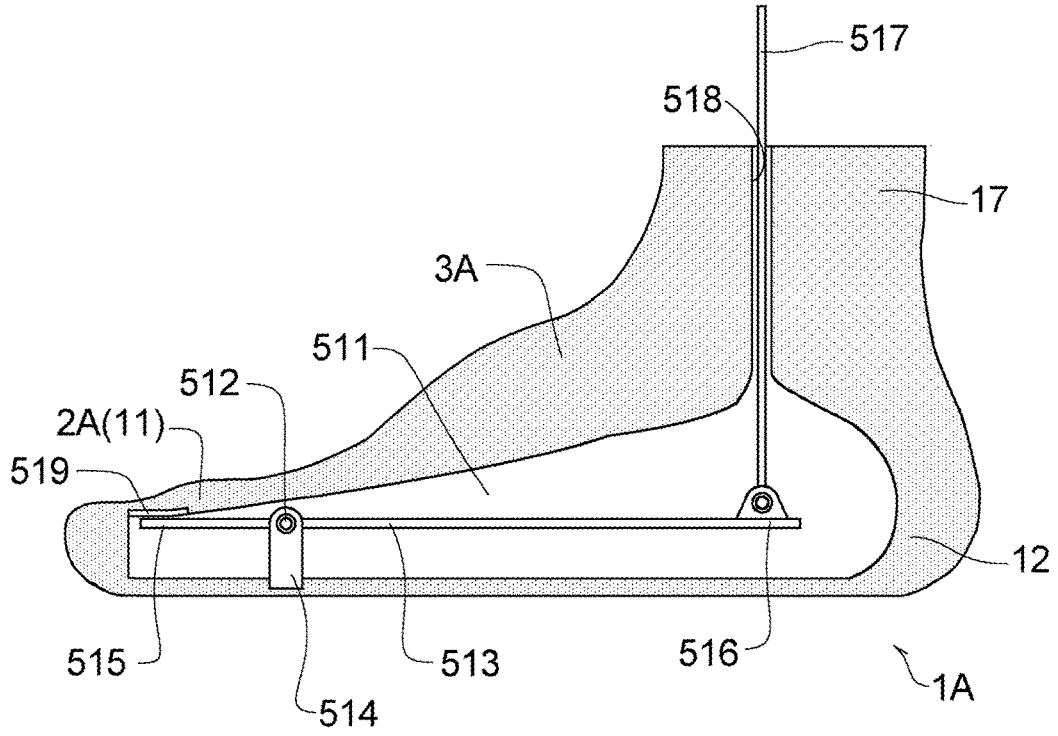
FIG. 4 is a left side view including a partial cross section illustrating a last of Example 1 having a variable portion whose position can be changed.
Figure 5:
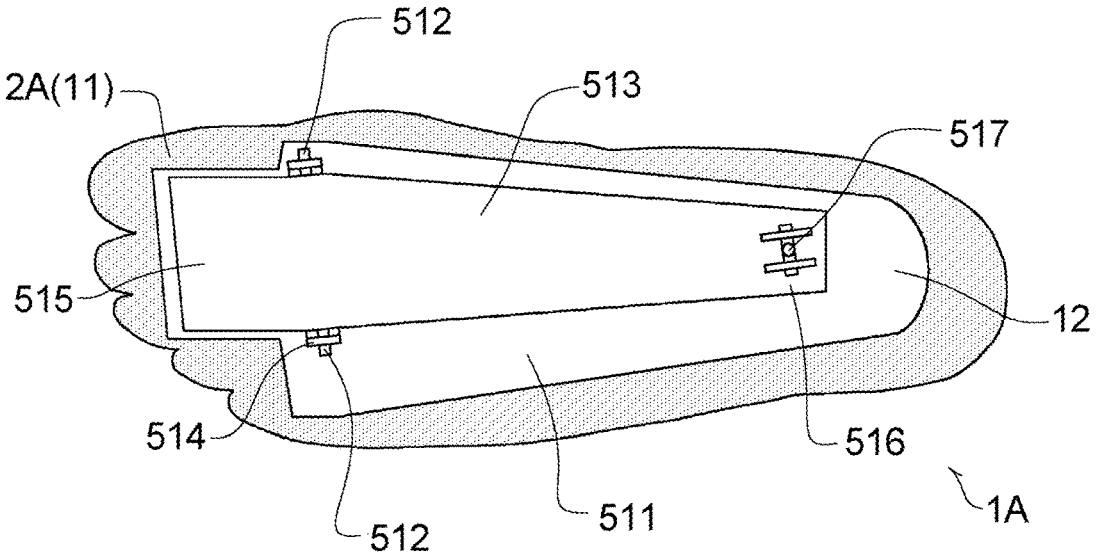
FIG. 5 is a top view including a partial cross section illustrating the last of Example 1.

FIGS. 4 and 5 are examples of a last 1A provided with a position variable portion whose position with respect to a main body portion 3A is changeable, and in particular, are examples of the last 1A provided with a position variable portion 2A whose angle with respect to the main body portion 3A is changeable. FIG. 4 is a side view of the last 1A provided with the position variable portion 2A, but in order to clearly illustrate a mechanism for changing the position variable portion 2A, the last 1A is illustrated in a cross section divided in a front-to-rear direction. Note that FIG. 4 is a side view as viewed in an axial direction of a shaft portion 512 (the same applies to FIG. 6). FIG. 5 is a top view of the last 1A, but for the same reason, the last 1A is illustrated in a cross section divided in a horizontal direction. In the cross section of the last 1A, dots are added to a range where the material for forming the last 1A exists (hereinafter, the same applies to other cross sections).

In FIGS. 4 and 5, the last 1A has the main body portion 3A and the position variable portion 2A. For example, the position variable portion 2A is disposed in the front portion 11 of the last 1A. That is, the front portion 11 of the last 1A serves as the position variable portion 2A. The position variable portion 2A disposed in the front portion 11 can change the angle with respect to the main body portion 3A.

In the illustrated example, the entire last 1A having the main body portion 3A and the position variable portion 2A is formed of a soft material. Inside the last 1A, a seesaw structure is provided as a mechanism for changing a position (a position with respect to the main body portion 3A) of the position variable portion 2A. Specifically, a cavity 511 capable of accommodating the seesaw structure is provided inside the last 1A. The seesaw structure has a plate member 513 provided with the shaft portion 512, and a support portion 514 that rotatably supports the shaft portion 512. The plate member 513 extends from the front portion 11 to the rear portion 12 of the last 1A, a first end portion 515 of the plate member 513 serving as a point of action is disposed in the front portion 11 of the last 1A, and a second end portion 516 of the plate member 513 serving as a point of force is disposed in the rear portion 12 of the last 1A. The support portion 514 serving as a fulcrum is fixed to the main body portion 3A in the vicinity of a virtual straight line passing through the MP joints of the big toe and the little toe. Therefore, as illustrated in FIG. 5, the axis of the shaft portion 512 extends slightly inclined with respect to a width direction.

An operation member 517 is provided at the second end portion 516 of the plate member 513 of the seesaw structure. The operation member 517 is formed of, for example, a rod-like body, and is inserted into a through hole 518 extending in a vertical direction provided in the ankle portion 17 of the last 1A. A diameter of the through hole 518 is sufficiently larger than a circumference of the operation member 517 so that the operation member 517 can also move back and forth when the operation member 517 is moved up and down. In addition, a lower end portion of the operation member 517 is pivotally attached to the second end portion 516 of the plate member 513, and an upper end portion of the operation member 517 protrudes above the ankle portion 17. By moving the operation member 517 up and down, the second end portion 516 of the plate member 513 also moves up and down. Note that the seesaw structure and the operation member 517 are formed of a hard material such as a metal or a hard resin.

Figure 6:
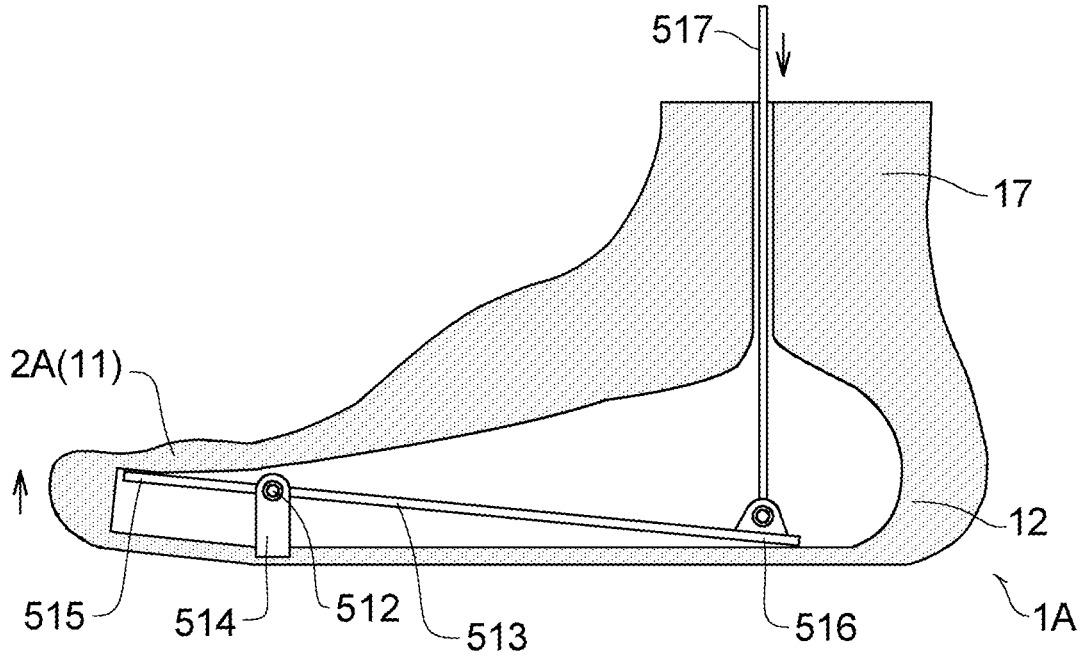
FIG. 6 is a left side view including a partial cross section illustrating a state where an angle of the variable portion of the last of Example 1 is changed.

As illustrated in FIG. 6, the operation member 517 is pushed downward using human power, a mechanical device, or the like. Then, the first end portion 515 of the plate member 513, which is the point of action, rises upward. Since the first end portion 515 is disposed in the front portion 11 of the last 1A and the last 1A is formed of a soft material, the first end portion 515 hits the front portion 11 from below, so that bending occurs near a virtual straight line provided with the support portion 514. As a result, the front portion 11 (position variable portion 2A) of the last 1A lifted upward by the first end portion 515 is inclined upward as indicated by an arrow. If necessary, a temporary fixing mechanism (not illustrated) for preventing the operation member 517 or the like from returning may be provided in order to fix (so-called positioning) the front portion 11 the angle of which is changed.

On the other hand, when the pushing down of the operation member 517 is released, the first end portion 515 of the plate member 513 is lowered, and the front portion 11 (position variable portion 2A) of the last 1A returns to the original position. In this way, in side view, the inclination angle of the front portion 11 of the last 1A with respect to the main body portion 3A can be changed.

Note that, when the entire last 1A is formed of a soft material, even if the first end portion 515 hits the front portion 11, the soft material forming the front portion 11 is only deformed, and the front portion 11 may not be sufficiently inclined. In consideration of such a point, as illustrated in FIG. 4, a deformation prevention plate 519 formed of a hard material such as a metal may be provided as necessary around a place where the first end portion 515 hits.

The operation member 517 and the plate member 513 are members that change the angle of the front portion 11 (position variable portion 2A) and also function as a load application unit. That is, when the operation member 517 is strongly pushed down, the second end portion 516 of the plate member 513 is lowered and strongly hits the bottom portion of the last 1A, and a load can be applied to the rear portion 12 of the last 1A. On the other hand, when the operation member 517 is strongly pulled up, the first end portion 515 of the plate member 513 is lowered and strongly hits the bottom portion of the last 1A, so that a load can be applied to the front portion 11 of the last 1A.

By changing the part where the load is applied to the last 1A while the last 1A is inserted into the shoe, the site where the wearing pressure on the bottom surface of the foot of the last 1A becomes the maximum value changes, and accordingly, the wearing pressure on the shoe on the bottom surface of the foot of the last 1A changes. In this way, the operation member 517 and the plate member 513, which are load application units, are configured to be able to apply a load so that the site where the wearing pressure on the bottom surface of the foot of the last 1A becomes the maximum value can be changed from the front portion 11 (first site) to the rear portion 12 (second site) of the last 1A or from the rear portion 12 to the front portion 11 of the last 1A.

In addition, as described above, when the operation member 517 is pushed down, the angle of the front portion 11 (position variable portion 2A) can be changed. For this reason, the operation member 517 and the plate member 513 also serving as the load application units are configured to be able to change the position of the position variable portion 2A with respect to the main body portion 3A in accordance with the change of the site having the maximum value of the wearing pressure on the bottom surface of the foot of the last 1A.

Figure 7:
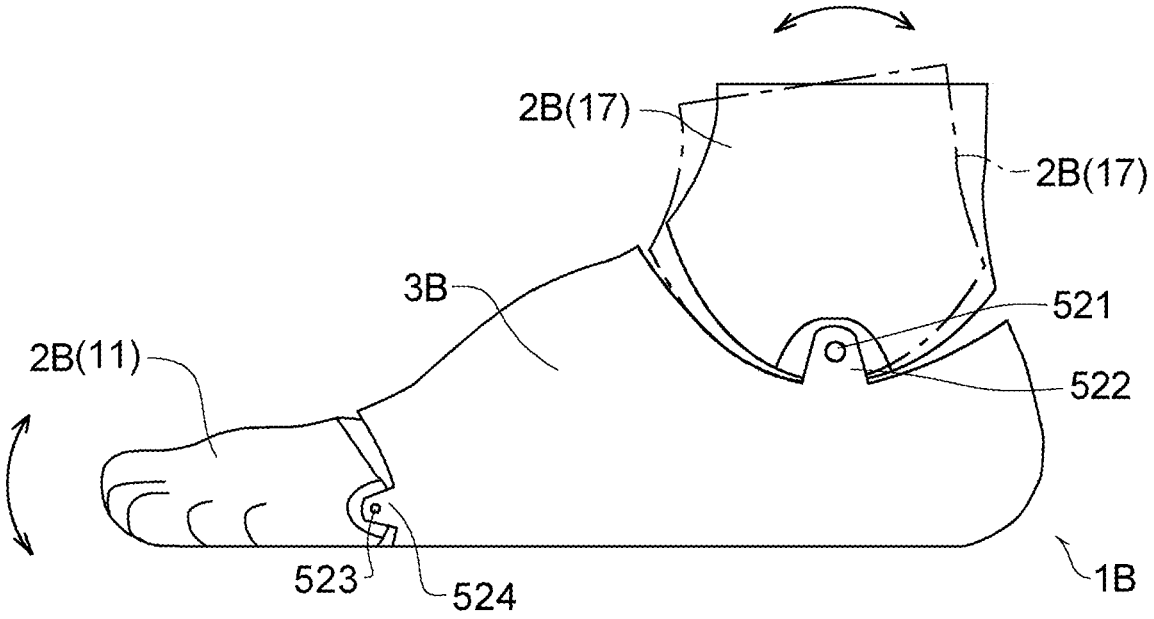
FIG. 7 is a left side view illustrating a last of Example 2 having a variable portion whose position can be changed.

FIG. 7 illustrates another example of a last 1B provided with a position variable portion 2B whose angle with respect to a main body portion 3B is changeable.

In FIG. 7, the position variable portion 2B is disposed at the ankle portion 17 of the last 1B. That is, the ankle portion 17 of the last 1B is the position variable portion 2B. The position variable portion 2B disposed in the ankle portion 17 can change the angle with respect to the main body portion 3B.

In the illustrated example, the main body portion 3B and the position variable portion 2B are formed separately, and the ankle portion 17, which is the position variable portion 2B, is rotatably attached to the main body portion 3B. Note that the main body portion 3B and the position variable portion 2B formed separately may be formed of the same material or may be formed of different materials. In addition, the main body portion 3B and the position variable portion 2B may be formed of a soft material or a hard material.

The ankle portion 17 (position variable portion 2B) has a shaft portion 521, and the shaft portion 521 of the ankle portion 17 is rotatably attached to a support portion 522 provided in the main body portion 3B. Although not particularly illustrated, the main body portion 3B may be provided with a shaft portion, and the ankle portion 17 (position variable portion 2B) may be provided with a support portion.

In this example, the ankle portion 17 is rotatable in a front-to-rear direction (a left-to-right direction in a side view in the drawing). If necessary, a gear, a pawl, a ratchet mechanism, or the like may be provided (not illustrated) in order to fix (so-called positioning) the ankle portion 17 having a changed angle.

When the ankle portion 17 is extruded forward, the ankle portion 17 tilts forward as illustrated by a dot-dash line in FIG. 7. When the ankle portion 17 is drawn rearward, the ankle portion 17 is inclined rearward.

In addition, for example, the front portion 11 may be the position variable portion 2B by a mechanism similar to that of the ankle portion 17. Briefly, as illustrated in FIG. 7, the front portion 11, which is the position variable portion 2B, is rotatably attached to the main body portion 3B. The front portion 11 (position variable portion 2B) has a shaft portion 523, and the shaft portion 523 is rotatably attached to a support portion 524 provided in the main body portion 3B. The front portion 11 is rotatable in a vertical direction (the vertical direction in the side view in the drawing), and can change an angle with respect to the main body portion 3B.

Figure 8:
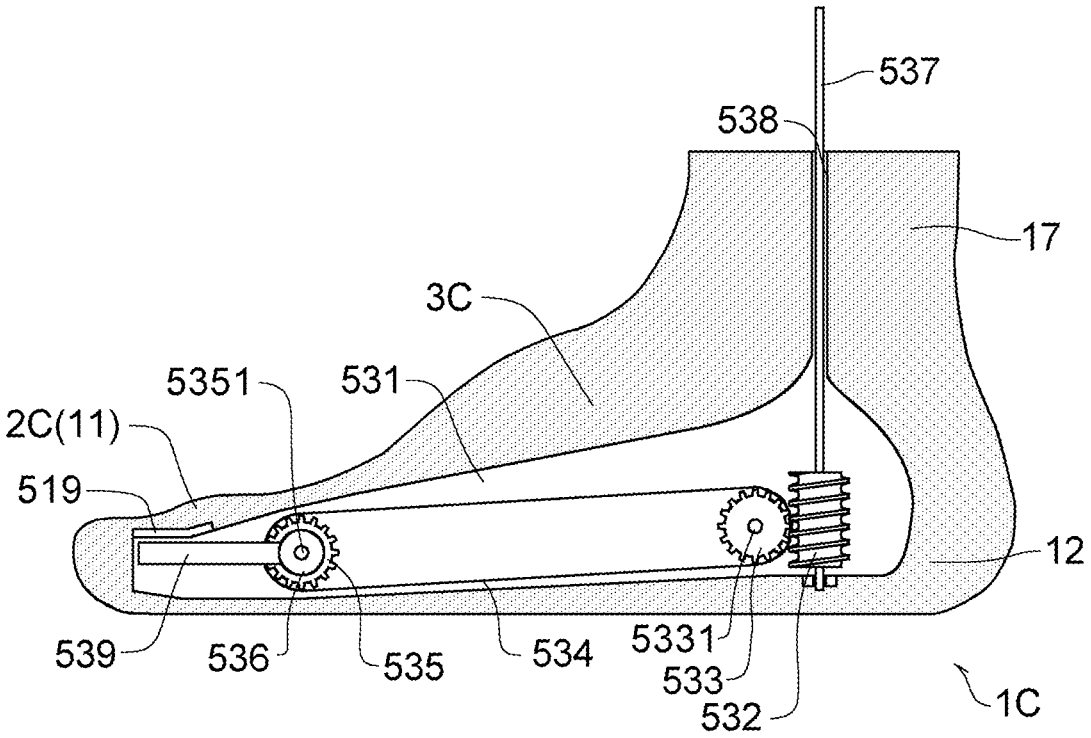
FIG. 8 is a left side view including a partial cross section illustrating a last of Example 3 having a variable portion whose position can be changed.

FIG. 8 illustrates still another example of a last 1C provided with a position variable portion 2C whose angle with respect to a main body portion 3C is changeable. FIG. 8 is a left side view of the last 1C having the position variable portion 2C, but as in FIG. 4, the last 1C is illustrated in a cross section divided in a front-to-rear direction. Note that FIG. 8 is a side view as viewed in an axial direction of a rotation center shaft 5351 of a sprocket 535 (the same applies to FIG. 9).

In FIG. 8, the position variable portion 2C is disposed in the front portion 11 of the last 1C.

In the illustrated example, the entire last 1C having the main body portion 3C and the position variable portion 2C is formed of a soft material. Inside the last 1C, a worm gear structure is provided as a mechanism for changing a position (a posture with respect to the main body portion 3C) of the position variable portion 2C. A cavity 531 capable of accommodating the worm gear structure is provided inside the last 1C. The worm gear structure has an operation member 537, a cylindrical worm 532 provided below the operation member 537, a worm wheel 533 meshing with the cylindrical worm 532, and the sprocket 535 connected to the worm wheel 533 via an endless belt 534. The operation member 537 is formed of, for example, a rod-like body, and is inserted into a through hole 538 extending in a vertical direction provided in the ankle portion 17 of the last 1C. The cylindrical worm 532 is fixed to the operation member 537 by an adhesive, screwing, or the like, and a lower end portion of the operation member 537 is rotatably attached to the main body portion 3C via a bearing. The sprocket 535 has a boss 536, and a plate-shaped raising portion 539 extending to the front portion 11 of the last 1C is fixed to the boss 536. In addition, the sprocket 535 is disposed near a virtual straight line passing through the MP joints of the big toe and the little toe. Therefore, an axis of the rotation center shaft 5351 of the sprocket 535 extends slightly inclined with respect to a width direction, and correspondingly, an axis of a rotation center shaft 5331 of the worm wheel 533 is parallel to the axis of the rotation center shaft 5351 of the sprocket 535. The worm wheel 533 and the sprocket 535 are rotatably attached to the last 1C via a support portion (not illustrated). Note that the worm gear structure and the operation member 537 are formed of a hard material such as a metal.

Figure 9:
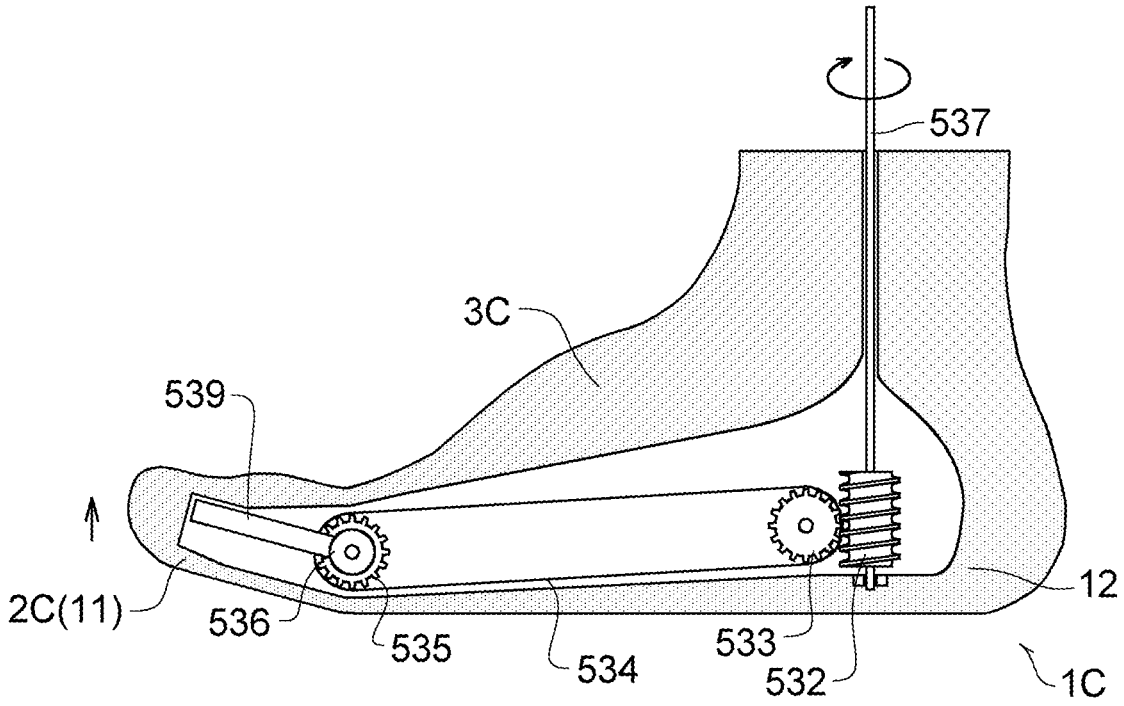
FIG. 9 is a left side view including a partial cross section illustrating a state where an angle of the variable portion of the last of Example 3 is changed.

The worm wheel 533 is rotated by rotating the operation member 537 around an axis. Due to the worm gear structure, the direction of rotation can be changed by 90 degrees. Rotation of the worm wheel is transmitted by the endless belt 534, and the sprocket 535 also rotates. As illustrated in FIG. 9, the raising portion 539 fixed to the boss 536 of the sprocket 535 rotates upward following sprocket 535, and pushes up the front portion 11 of the last 1C. Therefore, as indicated by an arrow, the front portion 11 (position variable portion 2C) of the last 1C is inclined upward.

Not that, for the same reason as in the last 1A, as illustrated in FIG. 8, a deformation prevention plate 519 formed of a hard material such as a metal may be provided as necessary around a place where the raising portion 539 hits.

The operation member 537 is a member that changes the front portion 11 (position variable portion 2C) and also functions as a load application unit. That is, when the operation member 537 is strongly pushed downward, a load can be applied to the rear portion 12 of the last 1C. The operation member 537 also serving as the load application unit is also configured to be able to change the site where the wearing pressure on the bottom surface of the foot becomes the maximum value from the site (first site) where the last 1C exists to the rear portion 12 (second site).

Figure 10:
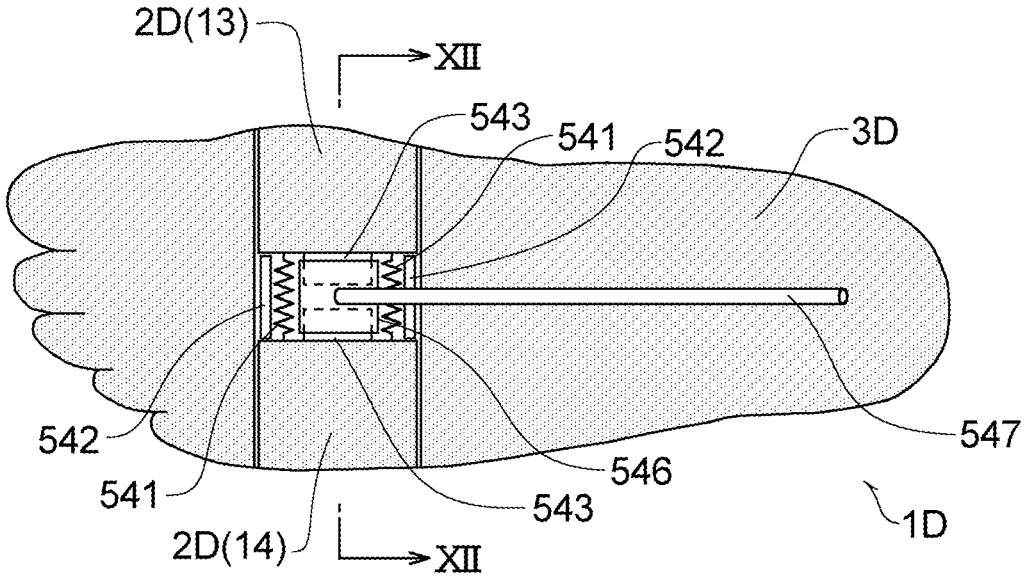
FIG. 10 is a top view including a partial cross section illustrating a last of Example 4 having a variable portion whose position can be changed.
Figure 11:
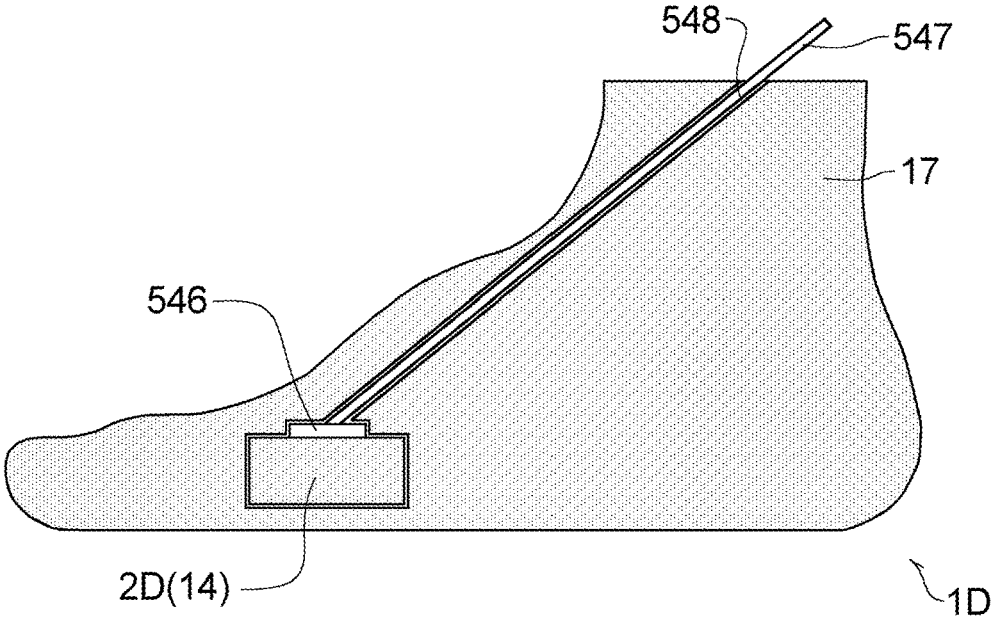
FIG. 11 is a left side view including a partial cross section illustrating the last of Example 4.
Figure 12:
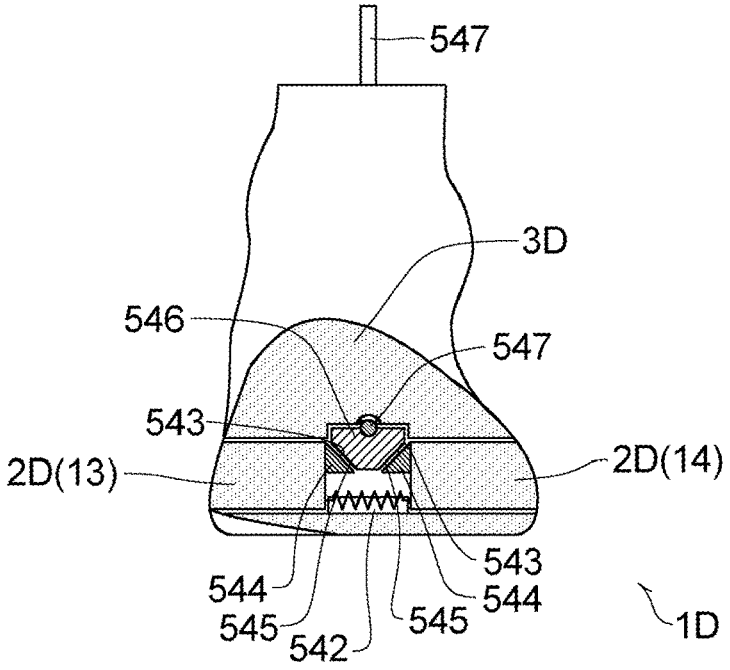
FIG. 12 is a cross-sectional view along line XII to XII in FIG. 10.

FIGS. 10 to 12 illustrate examples of a last 1D provided with a position variable portion 2D whose position with respect to a main body portion 3C is changeable, and in particular, examples of the last 1D provided with a position variable portion 2D whose distance with respect to the main body portion 3D is changeable. FIG. 10 is a top view of the last 1D provided with the position variable portion 2D, but as in FIG. 5, the last 1D is illustrated in a cross section divided in a horizontal direction. Similarly, FIG. 11 also illustrates the last 1D in a cross section. FIG. 12 is a cross-sectional view of the last 1D divided in a width direction.

In FIGS. 10 to 12, the position variable portion 2D is disposed on the side portions of the last 1D. That is, the side portions of the last 1D are the position variable portion 2D. The position variable portion 2D disposed on the side portions is attached to the main body portion 3D so as to be movable in parallel, and a distance with respect to the main body portion 3D can be changed. The position variable portion 2D may be disposed on one of the inner side portion 13 and the outer side portion 14, or may be disposed on both of them. In the illustrated example, both the inner side portion 13 and the outer side portion 14 are the position variable portion 2D.

In the illustrated example, the main body portion 3D and the position variable portion 2D (the inner side portion 13 and the outer side portion 14) are formed separately. The position variable portion 2D disposed on the inner side portion 13 and the outer side portion 14 is attached to the main body portion 3D so as to be movable in parallel in a width direction. A spring 541 is bridged between the inner side portion 13 and the outer side portion 14. For example, two springs 541 are provided at intervals in the front-to-rear direction. In addition, a stopper portion 542 that maintains a minimum interval between the inner side portion 13 and the outer side portion 14 is provided between the inner side portion 13 and the outer side portion 14. The stopper portion 542 is interposed between the inner side portion 13 and the outer side portion 14, which are drawn to each other by the springs 541, so that the inner side portion and the outer side portion are normally static and maintained at a predetermined interval. The main body portion 3D is provided with a mechanism that extrudes the inner side portion 13 and the outer side portion 14 to the left side and the right side in the width direction. The extruding mechanism has, for example, a receiving portion 544 provided on each of the inner side portion 13 and the outer side portion 14 and having an inclined surface 543, a pushing portion 546 having an inclined surface 545 in contact with each of the inclined surfaces 543, and a mechanism for moving the pushing portion 546 downward. As a mechanism for moving the pushing portion 546 downward, for example, a method using an extrusion rod, the seesaw structure, or the like can be used. For example, an end portion of an extrusion rod 547 is attached above the pushing portion 546. The extrusion rod 547 is inserted into a through hole 548 formed in the ankle portion 17 of the last 1D.

Figure 13:
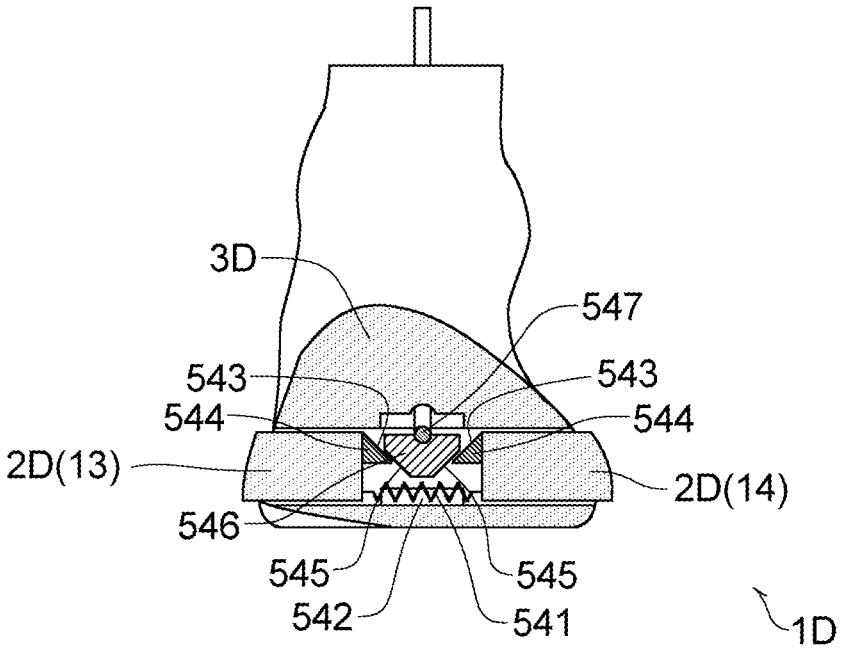
FIG. 13 is a cross-sectional view illustrating a state where a distance of the variable portion of the last of Example 4 is changed.

When the extrusion rod 547 is pushed down, the pushing portion 546 is lowered while the inclined surfaces 545 of the pushing portion 546 are in contact with the inclined surfaces 543 of the receiving portion 544. As illustrated in FIG. 13, when the pushing portion 546 is lowered, the inclined surfaces 545 of the pushing portion 546 extrude the receiving portions 544 to the left and right sides in the width direction, and the inner side portion 13 and the outer side portion 14 are extruded to the left and right sides in the width direction against the springs 541. On the other hand, when the pushing down of the extrusion rod 547 is released, the inner side portion 13 and the outer side portion 14 are drawn to each other by the springs 541, and the inner side portion 13 and the outer side portion 14 (position variable portion 2D) return to the original positions. In this way, the distance between the side portions of the last 1D can be changed.

Figure 14:
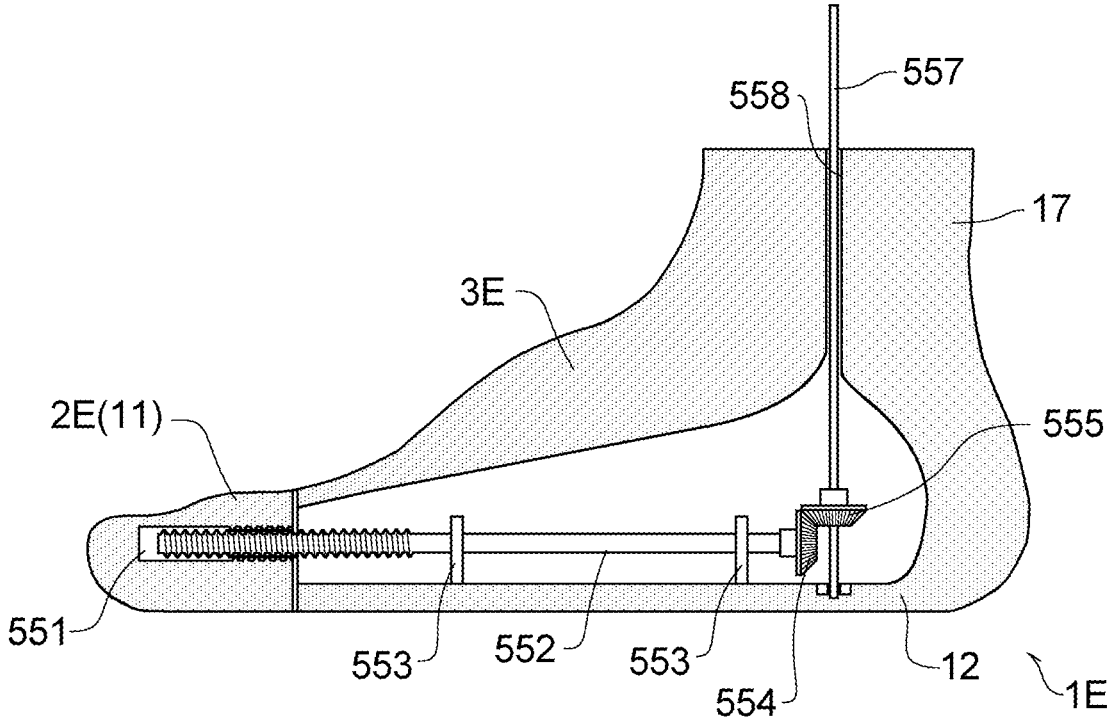
FIG. 14 is a left side view including a partial cross section illustrating a last of Example 5 having a variable portion whose position can be changed.

FIG. 14 illustrates another example of a last 1E provided with a position variable portion 2E whose distance with respect to a main body portion 3E is changeable. FIG. 14 is a left side view of the last 1E having the position variable portion 2E, but as in FIG. 4, the last 1E is illustrated in a cross section divided in the front-to-rear direction.

In FIG. 14, the position variable portion 2E is disposed in the front portion 11 of the last 1E. The position variable portion 2E disposed in the front portion 11 is attached to the main body portion 3E so as to be movable in parallel, and a distance with respect to the main body portion 3E can be changed.

In the illustrated example, the main body portion 3E and the front portion 11 (position variable portion 2E) are formed separately. The last 1E is provided with a mechanism that extrudes the front portion 11 forward. The extruding mechanism has, for example, a hole portion 551 provided inside the front portion 11 and having an inner peripheral surface on which a female screw is formed, a shaft portion 552 having a male screw formed to engage with the female screw of the hole portion 551, and a mechanism for rotating the shaft portion 552. The shaft portion 552 is formed of a linear rod-shaped body having an outer peripheral surface on which a male screw is formed and extending in the front-to-rear direction. The shaft portion 552 is inserted into the hole portion 551 of the front portion 11 in a state where the male screw is engaged with the female screw. In addition, the rear side of the shaft portion 552 is rotatably attached to a support portion 553 provided in the main body portion 3E. As a mechanism for rotating the shaft portion 552, for example, the worm gear structure, a bevel gear, or the like can be used. For example, a first bevel gear 554 is fixed behind the shaft portion 552. An operation member 557 is inserted into a through hole 558 extending in a vertical direction provided in the ankle portion 17, and the lower end portion of the operation member 557 is rotatably attached to the main body portion 3E via a bearing. A second bevel gear 555 meshing with the first bevel gear 554 is fixed to the operation member 557.

Figure 15:
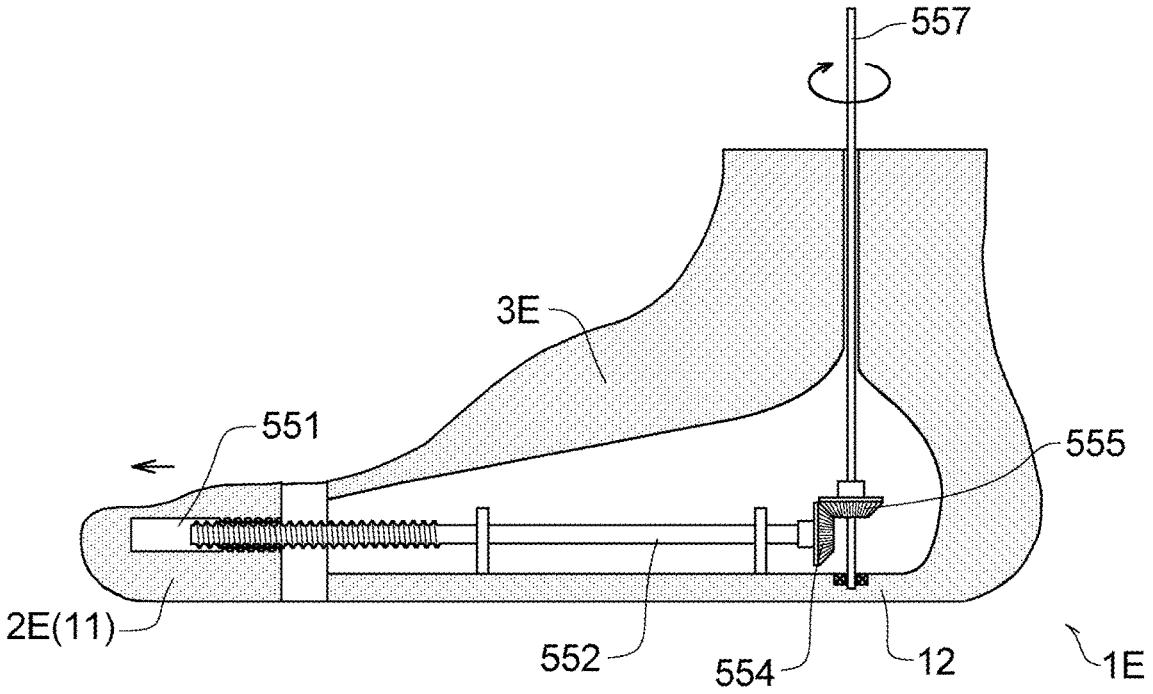
FIG. 15 is a left side view including a partial cross section illustrating a state where a distance of the variable portion of the last of Example 5 is changed.

By rotating the operation member 557 around an axis, the second bevel gear 555 rotates and the first bevel gear 554 rotates. By the meshing of the two bevel gears, the direction of rotation can be changed by 90 degrees. The rotation of the first bevel gear 554 rotates the shaft portion 552 about its axis. As illustrated in FIG. 15, since only the shaft portion 552 rotates in a state where the male screw of the shaft portion 552 is engaged with the female screw, the front portion 11 is extruded. On the other hand, by rotating the operation member 557 in the opposite direction, the shaft portion 552 also rotates in the opposite direction, and the front portion 11 is drawn rearward. In this way, the distance of the front portion 11 of the last 1E can be changed.

{Lasts Having Variable Portion Capable of Changing Shape}

In this section, some lasts in which a variable portion is provided whose shape can be changed will be described as examples. Hereinafter, the variable portion whose shape can be changed may be referred to as a "shape variable portion".

The shape variable portion is not particularly limited as long as it is a part of a last, for example, when the variable portion is disposed in at least one place selected from the front portion 11, the rear portion 12, side portions including the inner side portion 13 and the outer side portion 14, the arch of the foot portion 15, the instep portion 16, and the ankle portion 17 of the last. The mechanism for changing the shape of the shape variable portion is not particularly limited, and various mechanisms can be adopted.

Figure 16:
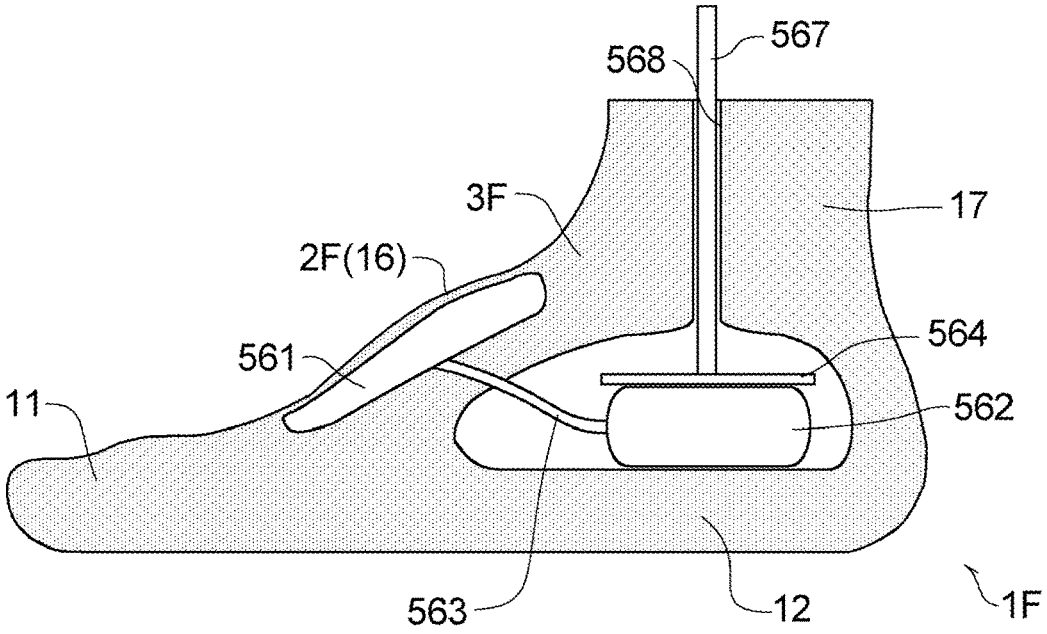
FIG. 16 is a left side view including a partial cross section illustrating a last of Example 6 having a variable portion whose shape can be changed.

FIG. 16 illustrates an example of a last 1F in which a shape variable portion 2F whose shape can be changed is provided. FIG. 16 is a left side view of the last 1F having the shape variable portion 2F, but as in FIG. 4, the last 1F is illustrated in a cross section divided in the front-to-rear direction.

In FIG. 16, the shape variable portion 2F is disposed on the instep portion 16 of the last 1F. That is, the instep portion 16 of the last 1F is the shape variable portion 2F. In the illustrated example, the entire last 1F having the main body portion 3F and the shape variable portion 2F is formed of a soft material. A plurality of bag portions airtightly filled with air and a communication passage serving as an air passage between the bags are provided inside the last 1F. For example, a first bag portion 561 having elasticity is provided inside the instep portion 16 of the last 1F, and a second bag portion 562 having elasticity is provided inside the rear portion 12 of the last 1F. Further, a flexible tube-shaped communication passage 563 is provided between the first bag portion 561 and the second bag portion 562. In addition, the last 1F is provided with a mechanism for pressing the second bag portion 562. As the pressing mechanism, for example, a plate portion 564 in surface contact with the second bag portion 562 and an operation member 567 attached to the plate portion 564 are provided. The operation member 567 is formed of, for example, a linear rod-shaped body extending in a vertical direction. The operation member 567 is inserted into a through hole 568 provided in the ankle portion 17 and extending in the vertical direction. In addition, the lower end portion of the operation member 567 is attached to the plate portion 564 having a surface in contact with the top surface of the second bag portion 562.

Figure 17:
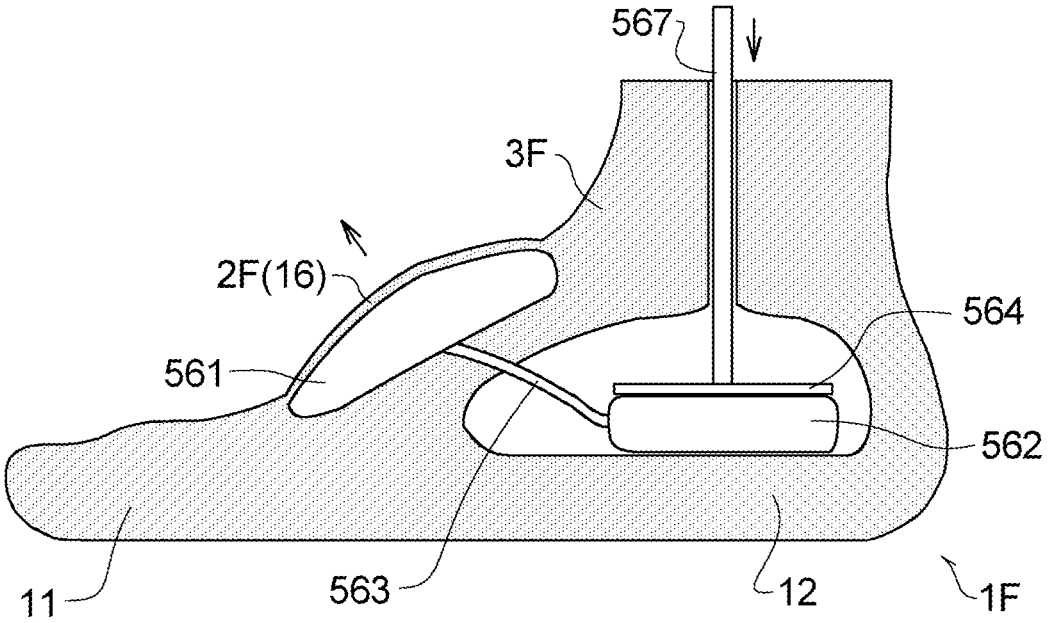
FIG. 17 is a left side view including a partial cross section illustrating a state where the shape of the variable portion of the last of Example 6 is changed.

As illustrated in FIG. 17, when the operation member 567 is pushed down, the second bag portion 562 is pressed by the plate portion 564. When the second bag portion 562 is pressed, the air in the second bag portion 562 moves into the first bag portion 561 through the communication passage 563, and the first bag portion 561 expands. When the first bag portion 561 expands, the instep portion 16 is extruded to the outside, and the shape of the instep portion 16 (shape variable portion 2F) changes. Note that, if necessary, in order to maintain the state where the second bag portion 562 is pressed, the position of the pushed down operation member 567 may be fixed (so-called positioning) to prevent the return of the operation member 567. On the other hand, by pulling up the operation member 567, the pressing of the second bag portion 562 by the plate portion 564 is released, the air having moved to the first bag portion 561 returns into the second bag portion 562, and the instep portion 16 returns to the original shape. The operation member 567 and the plate portion 564 are members that change the shape of the instep portion 16 (shape variable portion 2F) and also function as a load application unit. That is, when the operation member 567 is strongly pushed down, a load can be applied to the lower part of the second bag portion 562. In a state where the last 1F is inserted into a shoe, by changing a part where a load is applied to the last 1F, a site where a wearing pressure on the bottom surface of the foot of the last 1F becomes the maximum value changes, and accordingly, a wearing pressure on the shoe on the bottom surface of the foot of the last 1F changes. In this way, the operation member 567 and the plate portion 564, which are load application units, are configured to be able to apply a load so that the site where the wearing pressure on the bottom surface of the foot of the last 1F becomes the maximum value can be changed from the site (first site) where the last 1F exists to the site (second site) below the second bag portion 562.

In addition, as described above, when the operation member 567 is pushed down, the shape of the instep portion 16 (shape variable portion 2F) can be changed. Therefore, the operation member 567 and the plate portion 564 also serving as the load application units are configured to be able to change the shape of the shape variable portion 2F as the site having the maximum value of the wearing pressure on the bottom surface of the foot of the last 1F is changed.

Note that, as described above, the shape of the shape variable portion 2F is not limited to a case where the shape is changed by being extruded from the inside using air or the like, and can be appropriately changed. For example, the shape may be changed by preparing two or more constituent members having different shapes and replacing them. For example, when the position variable portion is the arch of the foot portion of the last, the shape of the arch of the foot portion (shape variable portion) can be changed by preparing an arch of the foot portion having a shape in which a height of the arch is low and an arch of the foot portion having a shape in which a height of the arch is higher than that, and replacing them.

{Lasts Having Variable Portion Capable of Changing Weight}

In this section, some lasts provided with a variable portion whose weight is changeable will be described as examples. Hereinafter, the variable portion whose weight is changeable may be referred to as a "weight variable portion".

The weight variable portion is not particularly limited as long as it is a part of the last, and is disposed, for example, at the front portion 11, the rear portion 12, side portions including the inner side portion 13 and the outer side portion 14, the arch of the foot portion 15, the instep portion 16, the ankle portion 17, or the like of the last.

The weight of the weight variable portion can be changed. By changing the weight of the weight variable portion, the position of the center of gravity of the last itself changes before and after the change.

Figure 18:
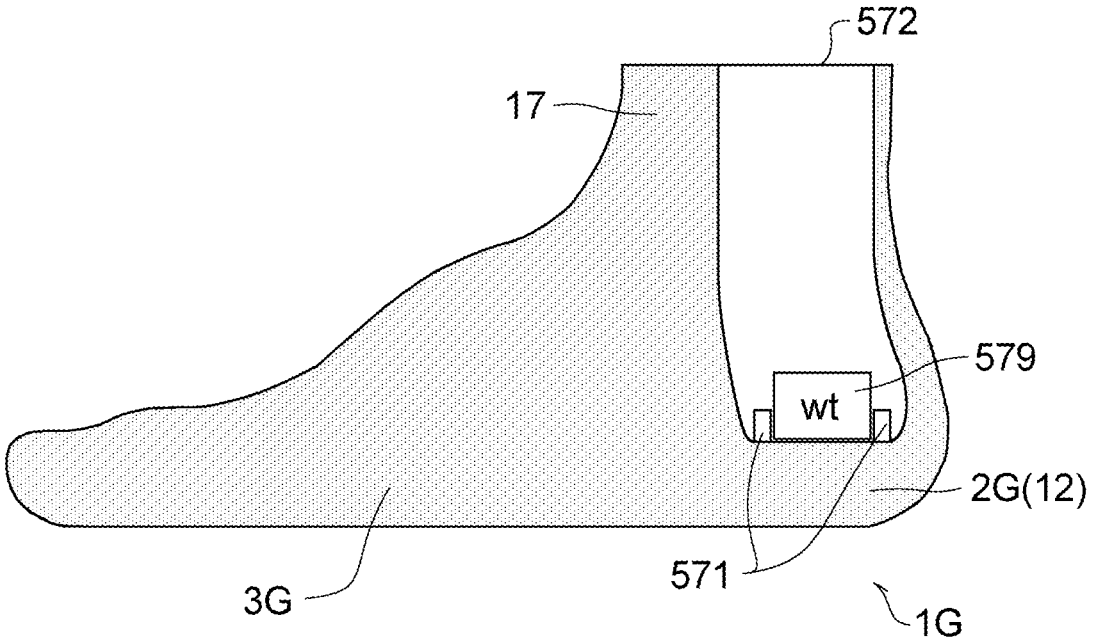
FIG. 18 is a left side view including a partial cross section illustrating a last of Example 7 having a variable portion whose weight can be changed.

FIG. 18 illustrates an example of a last 1G in which a weight variable portion 2G whose weight can be changed is provided. FIG. 18 is a left side view of the last 1G having the weight variable portion 2G, and as in FIG. 4, the last 1G is illustrated in a cross section divided in the front-to-rear direction.

In FIG. 18, the last 1G has a main body portion 3G and the weight variable portion 2G. The weight variable portion 2G is disposed at the rear portion 12 of the last 1G. The weight variable portion 2G has a weight holding portion 571 that holds a weight 579. The weight holding portion 571 is formed of a space portion that is provided inside the last 1G and can accommodate a weight. In the last 1G, for example, an opening portion 572 connected to the outside is formed in order to take the weight 579 into and out of the weight holding portion 571 from the outside. For example, the opening portion 572 is opened in the ankle portion 17. The weight holding portion 571 is disposed immediately below the opening portion 572. The weight of the rear portion 12 (weight variable portion 2G) can be changed by causing the weight holding portion 571 to hold the weight 579 through the opening portion 572. In this case, by increasing the weight of the rear portion 12, the center of gravity of the last 1G changes to the rear side. If necessary, it is possible to change the position of the center of gravity of the last 1G to several positions by preparing a plurality of weights having different weights and appropriately replacing the weights.

Note that the weight variable portion 2G is not limited to the case of having the weight holding portion 571 as described above, and can be appropriately changed. For example, the weight may be changed by preparing two or more constituent members having different weights and replacing them. For example, when the weight variable portion is the front portion 11 of the last, the weight of the front portion (weight variable portion) can be changed by preparing a first front portion having a certain weight and a second front portion having a larger weight than the first front portion and replacing them.

{Combinations of Position, Shape, and Weight}

The last may have a variable portion whose position and shape are changeable, may have a variable portion whose position and weight are changeable, may have a variable portion whose shape and weight are changeable, or may have a variable portion whose position, shape and weight are changeable.

<Load Application Unit>

The load application unit is used to apply a load to a last. The last itself also has a weight (load), but a further load can be applied to the entire last by the load application unit, or the position of the center of gravity can be arbitrarily changed.

The load application unit may be provided in the last having a variable portion, or may be provided in the last not having a variable portion.

Figure 19:
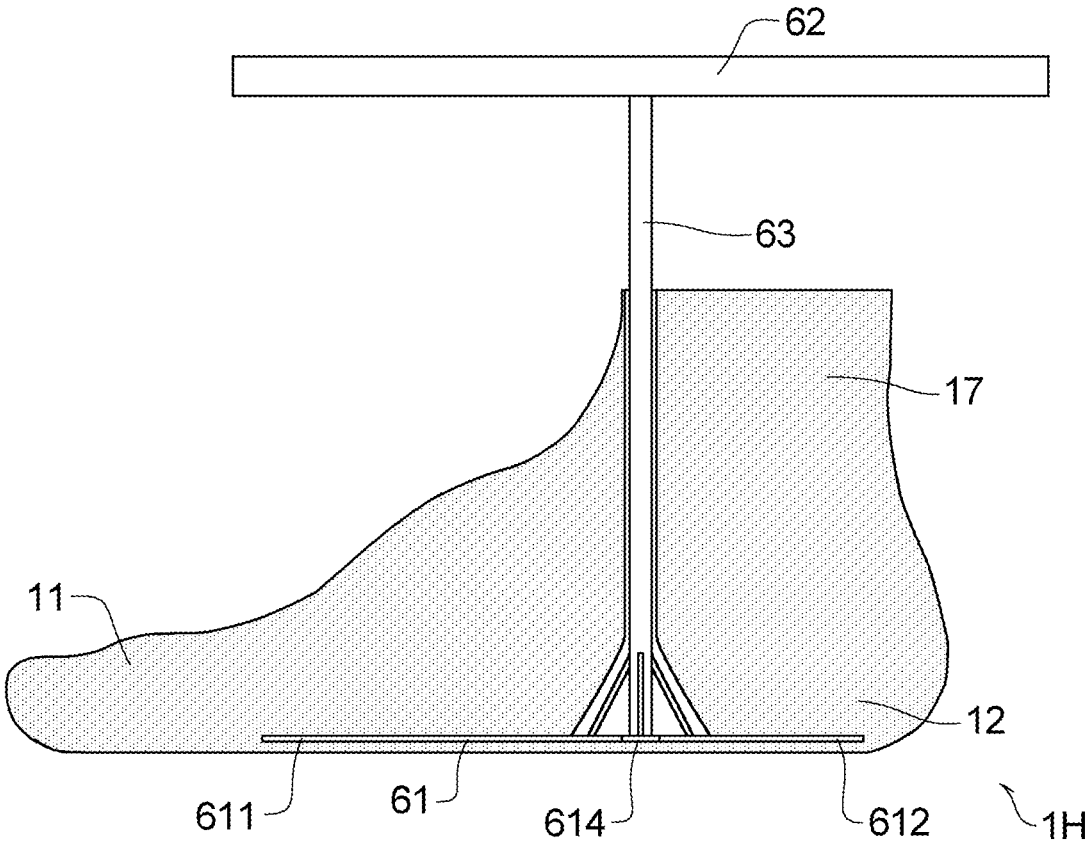
FIG. 19 is a left side view including a partial cross section illustrating a last of Example 8 having a load application unit.
Figure 20:
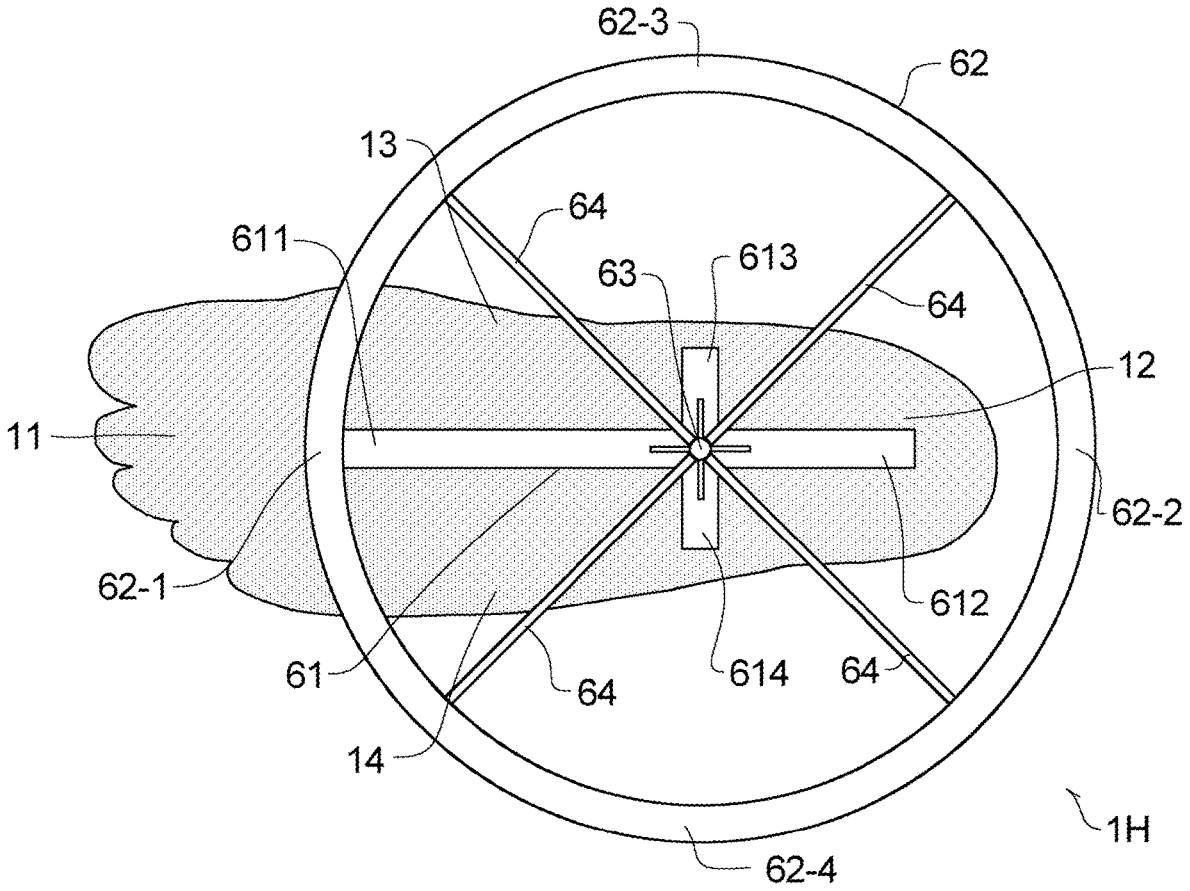
FIG. 20 is a top view including a partial cross section illustrating the last of Example 8.

FIGS. 19 and 20 are examples of a last 1H in which a load application unit (without a variable portion) is provided. FIG. 19 is a left side view of the last 1H provided with the load application unit, and similarly to FIG. 4, the last 1H is illustrated in a cross section divided in the front-to-rear direction. Similarly, FIG. 20 also illustrates the last 1H in a cross section.

The load application unit has an action portion 61 provided inside the last 1H and applying a load, an operation portion 62 applying a load, and a transmission portion 63 transmitting the load of the operation portion 62 to the action portion 61. The action portion 61, the operation portion 62, and the transmission portion 63 are formed of a hard material such as a metal. The action portion 61 is formed of, for example, a plate-like member, and is embedded in the material forming the last 1H. A lower end portion of the transmission portion 63 is fixed to the action portion 61. The action portion 61 has, for example, a first portion 611 extending forward and a second portion 612 extending rearward with respect to a place where the transmission portion 63 is fixed. If necessary, the action portion 61 may have a third portion 613 extending inward and a fourth portion 614 extending outward with respect to the place to which the transmission portion 63 is fixed. Note that, although not particularly illustrated, the action portion 61 may have a part extending obliquely between the first portion 611 and the third portion 613 and/or the fourth portion 614, a part extending obliquely between the second portion 612 and the third portion 613 and/or the fourth portion 614, or the like. The transmission portion 63 is formed of a rod-like body extending in a vertical direction, and is embedded in the ankle portion 17. The operation portion 62 is fixed to an upper end portion of the transmission portion 63. The operation portion 62 is formed of, for example, a ring-shaped member resembling a steering wheel of a vehicle, and is fixed to the upper end portion of the transmission portion 63 via a radially extending connection portion 64.

By applying a load (downward pressing force) to the entire operation portion 62 of the load application unit using human power, a mechanical device, or the like, the load can be applied to the last 1H as a whole. In addition, by applying a load to a front part 62-1 of the operation portion 62, the load is intensively applied to the first portion 611 of the action portion 61, and the load can be mainly applied to the front portion 11 of the last 1H. In addition, by applying a load to a rear part 62-2 of the operation portion 62, the load can be mainly applied to the rear portion 12 of the last 1H through the second portion 612 of the action portion 61, and by applying a load to an inner part 62-3 or an outer part 62-4 of the operation portion 62, the load can be mainly applied to the inner side portion 13 or the outer side portion 14 of the last 1H through the third portion 613 or the fourth portion 614 of the action portion 61. In a state where the last 1H is inserted into a shoe, by changing a part that applies a load to the last 1H, a site where the wearing pressure on the bottom surface of the foot of the last 1H becomes the maximum value changes, and accordingly, the wearing pressure on the bottom surface of the foot of the last 1H changes. The load application unit is configured to apply a load to the last 1H such that the site where the wearing pressure on the bottom surface of the foot of the last 1H becomes the maximum value can be changed from the first site (for example, the front portion 11) to the second site (for example, the rear portion 12) of the last 1H.

Note that, in FIGS. 19 and 20, a load application unit is provided in the last not having the variable portion, but the load application unit as illustrated may be provided in the last having the variable portion.

Figure 21:
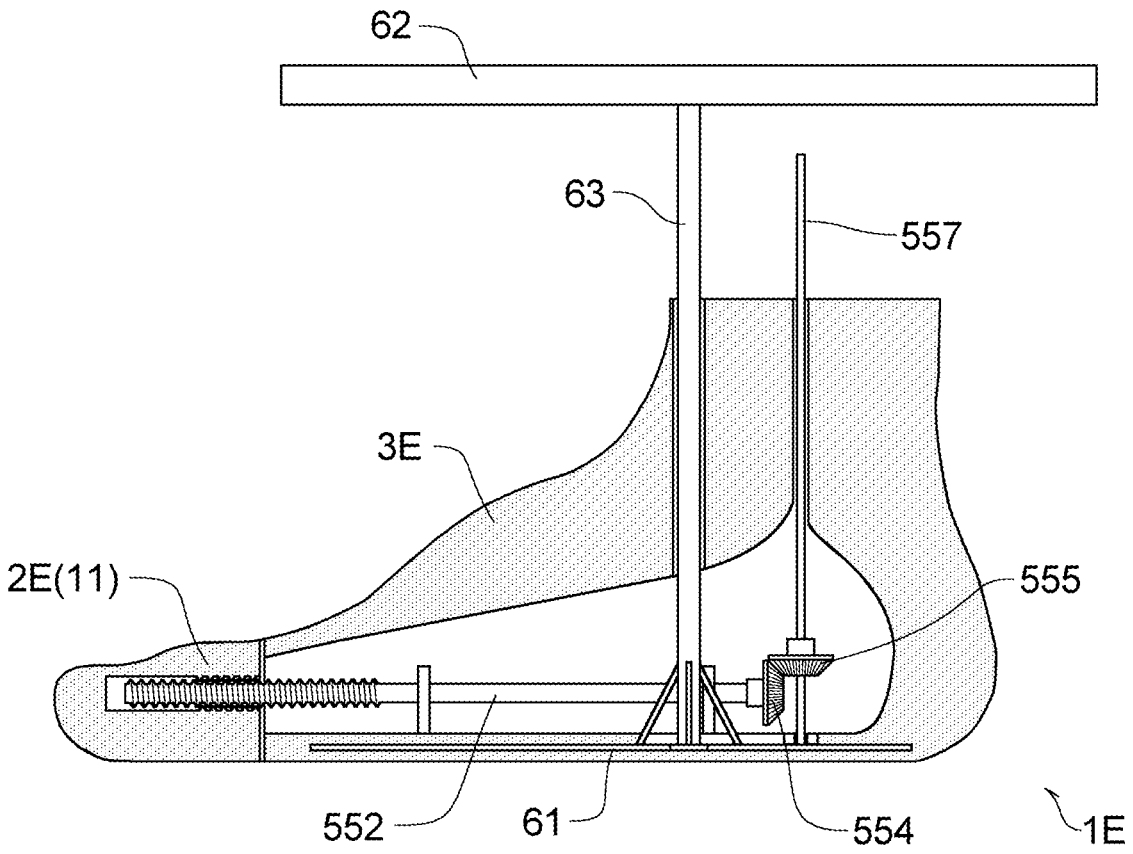
FIG. 21 is a left side view including a partial cross section illustrating a last of Example 9 having a variable portion and a load application unit.

For example, FIG. 21 illustrates an example of a case where the load application unit illustrated in FIGS. 19 and 20 is provided in the last 1E of FIG. 14 where the front portion 11 (position variable portion 2E) can protrude. The parts or members indicated by reference numerals in FIG. 21 are similar to those in FIGS. 14 and 19, so descriptions thereof are omitted.

In addition, for a last in the section <Last> in which an operation member or the like also serving as a load application unit is provided, a load application unit as illustrated in FIGS. 19 and 20 may be further provided.

<Pressure Measurement Unit>

The pressure measurement unit has an top surface pressure measurement unit that measures a wearing pressure on at least one place on an top surface of the foot of a last. Preferably, the pressure measurement unit has the top surface pressure measurement unit and a bottom surface pressure measurement unit that measures a wearing pressure on at least one place on a bottom surface of the foot at the last.

Structurally, the pressure measurement unit has, for example, a pressure sensor, an arithmetic processing unit, and a wiring unit that is provided between the pressure sensor and the arithmetic processing unit and transmits an electrical signal from the pressure sensor to the arithmetic processing unit. Note that, in a case where near-field communication such as Bluetooth is possible between the pressure sensor and the arithmetic processing unit, the wiring unit may be omitted.

Figure 22:
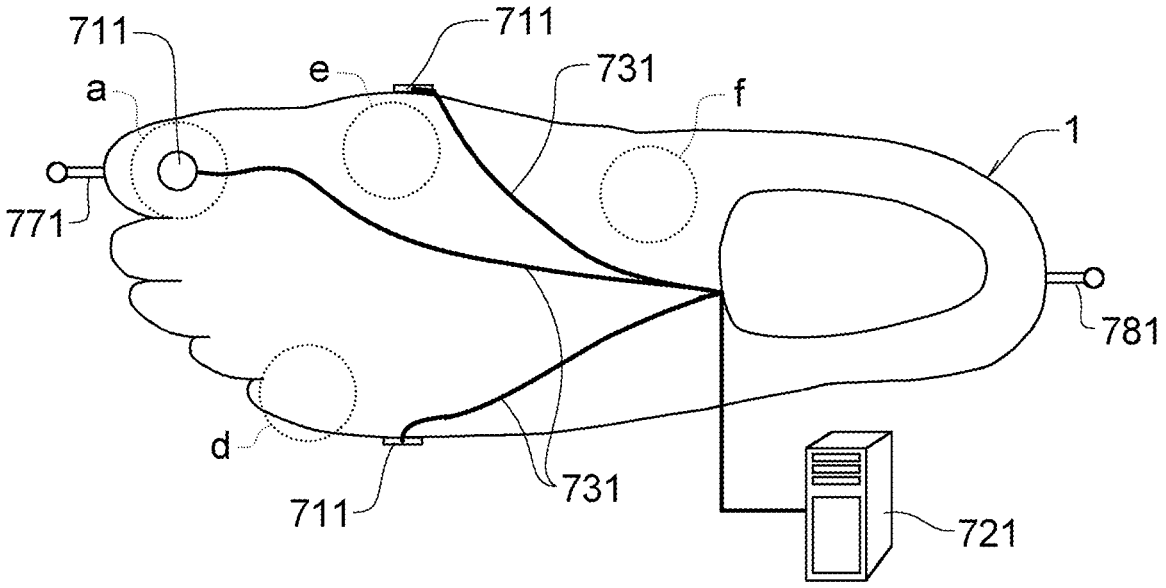
FIG. 22 is a top view illustrating a last where a pressure measurement unit and a gap measurement unit are provided.
Figure 23:
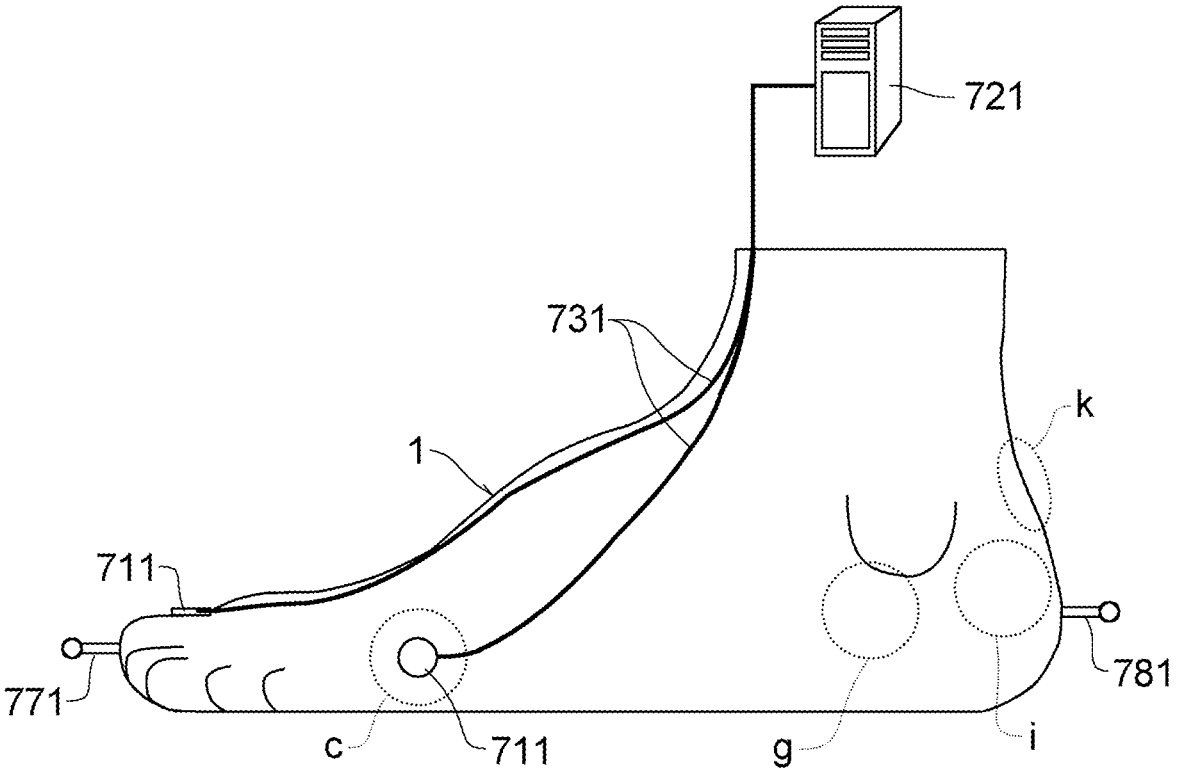
FIG. 23 is a left side view of the same.
Figure 24:
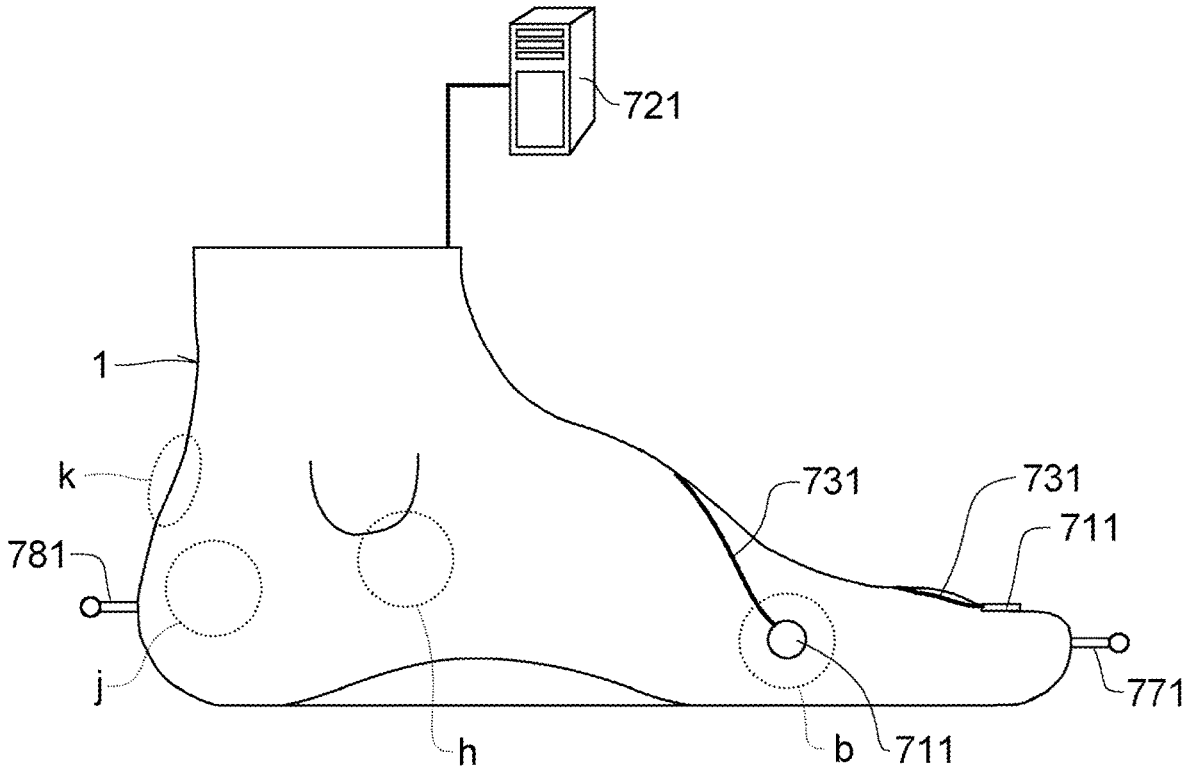
FIG. 24 is a right side view of the same.

FIGS. 22 to 24 are reference views schematically illustrating the top surface pressure measurement unit configured to measure the wearing pressure on the top surface of the foot of the last 1.

The top surface pressure measurement unit has, for example, a pressure sensor 711 disposed on the top surface of the foot of last 1, an arithmetic processing unit 721, and a wiring unit 731 electrically connecting the pressure sensor 711 and the arithmetic processing unit 721.

The pressure sensor 711 of the top surface pressure measurement unit is provided in at least one place on the top surface of the foot of the last 1, and is preferably provided at a plurality of places. When the pressure sensors 711 are provided at a plurality of places on the top surface of the foot of the last 1, it is preferable to provide the pressure sensors at least on a big toe a, a big toe ball side surface b, and a little toe ball c indicated by dotted lines in FIGS. 22 to 24. Furthermore, if necessary, the pressure sensor 711 may also be provided at one or two or more places selected from a little toe d, a big toe ball top surface e, a metatarsal f, a lateral malleolus g, a medial malleolus h, a lateral heel i, a medial heel j, a heel center k, or the like indicated by dotted lines in FIGS. 22 to 24. FIGS. 22 to 24 illustrate a case where pressure sensors are provided on the big toe a, the big toe ball side surface b, and the little toe ball c on the top surface of the foot of the last 1.

Figure 25:
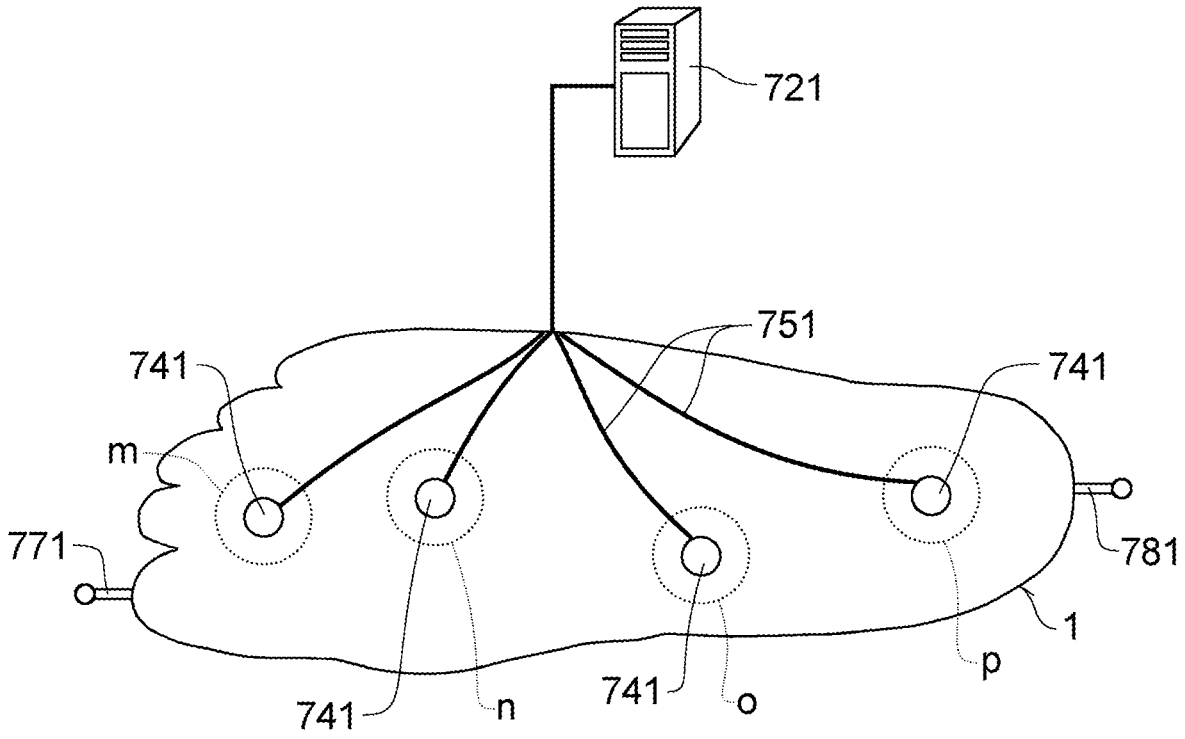
FIG. 25 is a bottom view of the same.

FIG. 25 is a reference view schematically illustrating a bottom surface pressure measurement unit that measures the wearing pressure on the bottom surface of the foot of the last 1.

The bottom surface pressure measurement unit has, for example, a pressure sensor 741 disposed on the bottom surface of the foot of the last 1, the arithmetic processing unit 721, and a wiring unit 751 that connects the pressure sensor 741 and the arithmetic processing unit 721.

The pressure sensor 741 of the bottom surface pressure measurement unit is provided in at least one place on the bottom surface of the foot of the last 1, and is preferably provided at a plurality of places. When the pressure sensors 741 are provided at a plurality of places on the bottom surface of the foot of the last 1, it is preferable to provide the pressure sensors 741 on at least a toe m, a tread n, an arch o, and a heel p indicated by dotted lines in FIG. 25. Furthermore, the pressure sensor 741 may be provided at a place other than these as necessary. FIG. 25 illustrates a case where the pressure sensors 741 are provided on the toe m, the tread n, the arch o, and the heel p of the bottom surface of the foot of the last 1.

The pressure sensor is a sensor that measures a pressure applied thereto by a pressure-sensitive element, converts the pressure into an electrical signal, and outputs the electrical signal. As the pressure sensor, a conventionally known sensor can be used, and for example, an air pack type contact pressure sensor, a capacitive type sensor, a piezoelectric element type sensor, a resistive film type sensor, or the like can be used. In one example, as a commercially available pressure sensor, for example, a product with the name "Air-Pack Type Contact Surface Pressure Measuring System (AMI 3037-10-II)" manufactured by AMI Techno Co., Ltd. can be used.

The arithmetic processing unit 721 has an A/D converter that receives a signal from the pressure sensors 711 and 741 and converts an analog signal into digital data, and calculates the digital data to calculate a pressure value. As the arithmetic processing unit 721, a so-called personal computer can be used. Note that, when the pressure sensors 711 and 741 are provided with an A/D converter function, the A/D converter of the arithmetic processing unit 721 is omitted.

In addition, the arithmetic processing unit 721 may have a monitor that displays various information, an input/output unit such as a keyboard, a storage unit such as a volatile memory or a nonvolatile memory, a printer that prints arbitrary information, or the like (none of these are illustrated).

<Gap Measurement Unit>

The gap measurement unit includes a front gap measurement unit configured to measure a gap between a front end portion of the last and an inner front end portion of the shoe in a state where the last is inserted into the shoe, and a rear gap measurement unit configured to measure a gap between a rear end portion of the last and an inner rear end portion of the shoe in a state where the last is inserted into the shoe.

The gap measurement unit may have both the front gap measurement unit and the rear gap measurement unit, or may have either one of the front gap measurement unit and the rear gap measurement unit. In a case where either one is included, it is preferable to include a front gap measurement unit.

In the examples of FIGS. 22 to 25, both the front gap measurement unit and the rear gap measurement unit are provided in the last as the gap measurement unit.

The front gap measurement unit has, for example, a distance sensor 771 disposed at the front end portion of the last, the arithmetic processing unit 721, and a wiring unit (not illustrated) that connects the distance sensor 771 and the arithmetic processing unit 721. The rear gap measurement unit has, for example, a distance sensor 781 disposed at the rear end portion of the last, the arithmetic processing unit 721, and a wiring unit (not illustrated) that connects the distance sensor 781 and the arithmetic processing unit 721. Note that, in a case where near-field communication such as Bluetooth is possible between the distance sensors 771 and 781 and the arithmetic processing unit 721, the wiring unit may be omitted.

As the distance sensors 771 and 781, a conventionally known sensor can be used, and for example, a contact sensor such as a needle-type sensor, a non-contact sensor such as a laser distance sensor, an infrared distance sensor, an ultrasonic distance sensor; or the like can be used. In one example, as the commercially available distance sensor, for example, a product with the name "High-Accuracy Digital Contact Sensor (GT2-P12KL)" manufactured by Keyence Corporation can be used. Each drawing illustrates a case where a needle-type sensor is used as the distance sensors 771 and 781.

The arithmetic processing unit 721 is as described in the section <Pressure measurement unit>. Note that, in the illustrated example, the arithmetic processing unit 721 of the gap measurement unit is also used for the arithmetic processing unit 721 of the pressure measurement unit, but different arithmetic processing units may be used for each of the gap measurement unit and the pressure measurement unit.

Note that the pressure measurement unit and the gap measurement unit are not illustrated in the lasts of the sections <Last> and <Load application unit>, but it should be noted that the pressure measurement unit and the gap measurement unit as illustrated in FIGS. 22 to 25 are provided in these lasts.

[Measurement Method]

In the measurement method, a last selected from the various aspects is used to measure a wearing pressure and a gap to acquire wearing pressure data and gap data in each portion of the top surface of the foot and the bottom surface of the foot.

Figure 26:
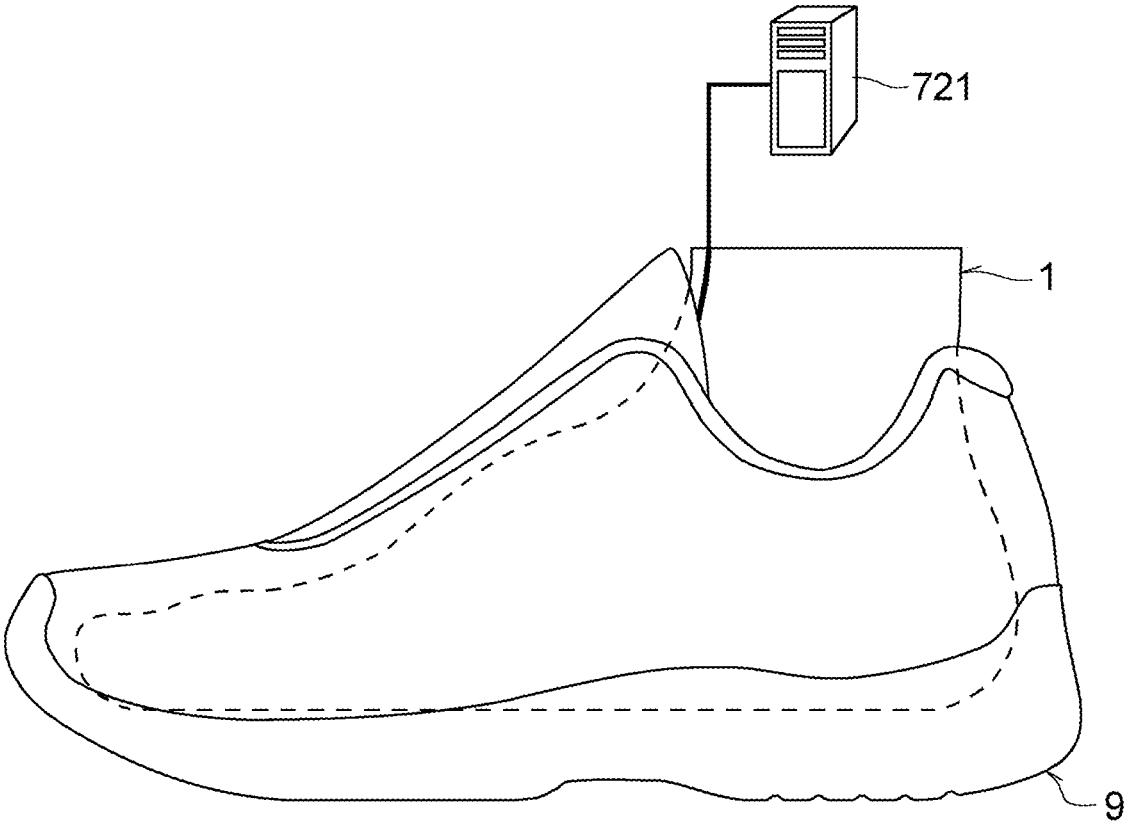
FIG. 26 is a left side view of a shoe into which a last is inserted.

As illustrated in FIG. 26, the last 1 selected from the various aspects is inserted into a shoe 9 (shoe insertion step). The wearing pressure of the last is measured by the pressure measurement unit (pressure measurement step). The gap measurement unit measures at least one of a gap between the front end portion of the last and the inner front end portion of the shoe and a gap between the rear end portion of the last and the inner rear end portion of the shoe (gap measurement step). The pressure measurement step and the gap measurement step are performed after the last is inserted into the shoe, but the execution order is not particularly limited, and the pressure measurement step may be performed first, the gap measurement step may be performed first, or both steps may be performed simultaneously and in parallel.

Usually, in order to confirm whether the last is inserted at a standard position, it is preferable to perform the pressure measurement step after performing the gap measurement step. That is, after inserting the last into the shoe, the gap of the front end portion of the last and/or the gap of the rear end portion of the last are measured by the gap measurement unit. With reference to the obtained gap data, it is confirmed that the last is inserted at the standard position, and then the wearing pressure of the last is measured. At least the wearing pressure on the top surface of the foot of the last is measured. Preferably, the wearing pressure on the top surface of the foot of the last and the wearing pressure on the bottom surface of the foot of the last are measured.

In addition, after the measurement of the wearing pressure, the gap at the front end portion of the last and/or the gap at the rear end portion of the last may be measured by the gap measurement unit, or after the measurement of the gap at the front end portion of the last and/or the gap at the rear end portion of the last, the wearing pressure may be measured, and further, the gap at the front end portion of the last and/or the gap at the rear end portion of the last may be measured by the gap measurement unit.

Figure 27A:
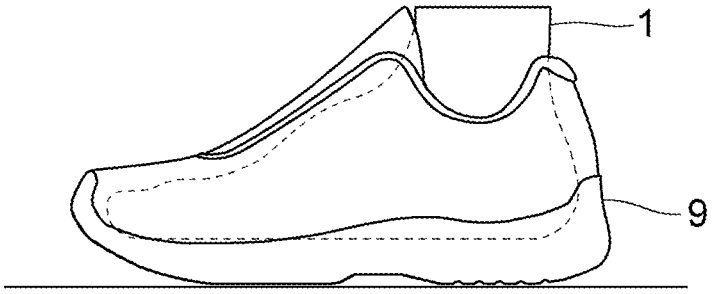
FIGS. 27A to 27C are left side views illustrating a direction of a shoe into which a last is inserted when measuring a wearing pressure and a gap.
Figure 27B:
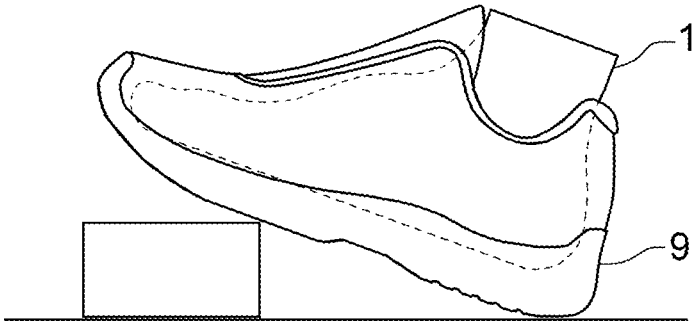
Figure 27C:
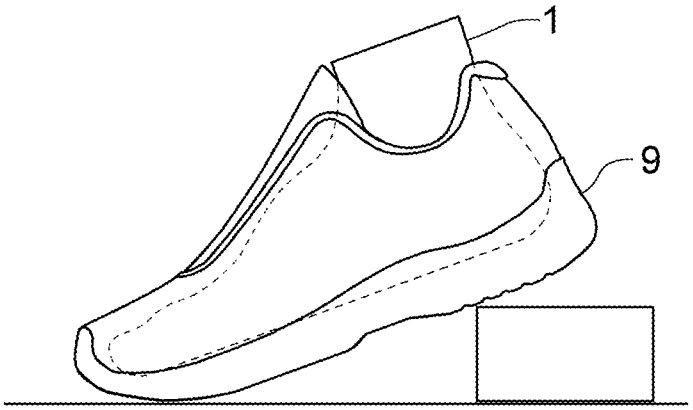

In general, as illustrated in FIG. 27A, the pressure measurement step and/or the gap measurement step are performed in a state where the shoe 9 into which the last 1 is inserted is placed on a horizontal surface. If necessary, as illustrated in FIG. 27B, the pressure measurement step and the gap measurement step may be performed by raising the toe of the shoe 9 into which the last 1 is inserted and causing the shoe 9 to be in an inclined state of the heel being lowered. Alternatively, as illustrated in FIG. 27C, the pressure measurement step and the gap measurement step may be performed by lowering the toe of the shoe 9 into which the last 1 is inserted and causing the shoe 9 to be in an inclined state of the heel being raised.

When a last having the variable portion is used, the pressure measurement step is performed before changing the state of the variable portion (shape, weight, and/or position relative to the main body portion), while changing the state of the variable portion, or after changing the state of the variable portion. The pressure measurement step may be performed at a time of at least one of before changing the state of the variable portion, while changing the state of the variable portion, and after changing the state of the variable portion. Usually, the pressure measurement step is performed before changing the state of the variable portion and while and/or after changing the state of the variable portion. If necessary, the gap measurement step may be performed at a time of at least one of before changing the state of the variable portion, while changing the state of the variable portion, and after changing the state of the variable portion. Usually, as described above, the gap measurement step is performed at least before changing the state of the variable portion in order to confirm whether the last is inserted at the standard position, and may be performed while and/or after changing the state of the variable portion as necessary.

When a last having the load application unit is used, the pressure measurement step is performed before applying a load to the last, while applying a load to the last, or after applying a load to the last. The pressure measurement step may be performed at a time of at least one of before the application of the load, during the application of the load, and after the application of the load. Usually, the pressure measurement step is performed before the application of the load and during and/or after the application of the load. If necessary, the gap measurement step may be performed at a time of at least one of before the application of the load, during the application of the load, and after the application of the load. Usually, the gap measurement step is performed at least before the application of the load in order to confirm whether the last is inserted at the standard position as described above, and may be performed during and/or after the application of the load as necessary.

By using a last having the variable portion and/or the load application unit, a fitting of the shoe when the wearer actually wears the shoe and is active can be appropriately evaluated. That is, in a conventional method of measuring a wearing pressure using a last, since a state of the last is unchanged, it is equivalent to measuring the wearing pressure when a foot of a wearer is stationary. In addition, in the conventional method of measuring the wearing pressure using the last, since the weight (load) of the last is only applied to the shoe, the wearing pressure in a state approximating a state where the wearer actually wears the shoe cannot be measured. When the wearer wears the shoe and is active, a state of the foot such as a shape changes, and a part to which the load is intensively applied also changes. By using the last having the variable portion and/or the load application unit, it is possible to measure a wearing pressure and/or a gap not only in a state where the wearer actually wears the shoe, stands posture, and is stationary, but also when the wearer is active. According to the preferred embodiment, the state approximating the state where the wearer actually wears the shoe can be reproduced with the last, and the fitting of the shoe can be appropriately evaluated.

Figure 28:
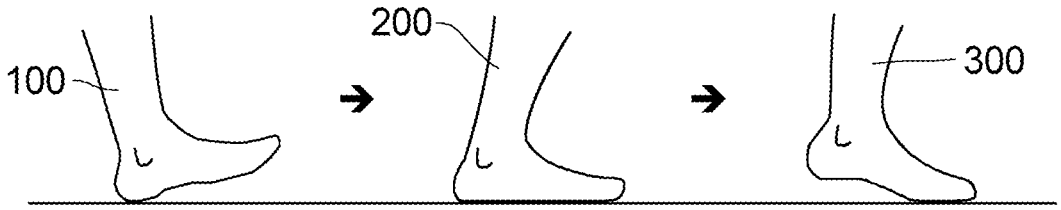
FIG. 28 is a reference view schematically illustrating a movement of a foot when a person is walking.

FIG. 28 is a reference view schematically illustrating movement of a foot when a person is walking.

A state of reference numeral 100 in FIG. 28 indicates a state where a heel is on the ground while walking and a toe is raised from the ground (hereinafter, referred to as "heel contact"), a state of reference numeral 200 indicates a state where substantially the entire sole of a foot is in contact with the ground (hereinafter, referred to as "foot flat"), and a state of reference numeral 300 indicates a state where the heel is raised and the toe is on the ground (hereinafter, referred to as "heel raised").

In the heel contact, the weight of the wearer is concentrated on the heel, and the center of gravity of the foot is closer to the heel of the foot. In the foot flat, the center of gravity of the foot is close to substantially the center in the front-to-rear direction, and a foot width is expanded. In the foot flat, the center of gravity of the foot is shifted toward the toes of the foot, a front portion of the foot is bent, and the foot width is expanded. In addition, an ankle of the wearer is inclined back and forth in the course from the heel contact toward the heel raised. In this way, when the wearer actually wears the shoe and is active, the shape of the foot changes or the position of the center of gravity changes.

An outline of evaluating a fitting of a shoe when a wearer walks will be described.

First, a last is inserted into the shoe (shoe insertion step), and the shoe is allowed to be static in a horizontal state as illustrated in FIG. 27A. The gap measurement unit measures the gap at the front end portion and/or the gap at the rear end portion of the last (gap measurement step), and confirms that the last is inserted at the standard position. A load is applied to the entire last via the load application unit by a method such as pushing in the load application unit with human power or a mechanical device, or placing a weight on the load application unit. After the load is applied, the wearing pressure on the top surface of the foot and, if necessary, on the bottom surface of the foot is measured (pressure measurement step). The thus obtained wearing pressure data and gap data can be evaluated as the fitting of the shoe in a state approximating the wearer standing posture and stationary.

Next, the wearing pressure and/or the gap are measured while changing the variable portion and/or changing the portion to which the load is mainly applied, or after changing the variable portion and/or the portion to which the load is mainly applied.

For example, in order to reproduce the heel contact, a load is applied to the rear portion of the last by the load application unit, the center of gravity of the last is changed to the rear side, and the wearing pressure and the gap as necessary are measured during and/or after the change. At this time, as illustrated in FIG. 27B, the wearing pressure or the like may be measured with the shoe in an inclined state with the toe being raised. Note that, for the change of the part to which the load is applied by the load application unit, refer to <Last> and <Load application unit> described above (hereinafter, the same shall apply).

Furthermore, in order to reproduce the foot flat, a load is applied to the entire last by the load application unit, and a distance of the position variable portion is changed to expand the side portion of the last to both the left and right sides (widening the width of the last), and the wearing pressure and the gap as necessary are measured during and/or after the change. For the change in the distance of the position variable portion, refer to the description of FIGS. 10 to 13 in the section <Last>. At this time, as illustrated in FIG. 27A, the wearing pressure or the like may be measured with the shoe in a horizontal state.

Furthermore, in order to reproduce the heel raised, a load is applied to the front portion of the last by the load application unit, the center of gravity of the last is changed to the front side, and the angle of the position variable portion is changed to incline the front portion of the last upward, and the wearing pressure and the gap as necessary are measured during and/or after the change. For the change in the angle of the position variable portion, refer to the description of FIGS. 4 to 9 in the section <Last>. At this time, as illustrated in FIG. 27C, the wearing pressure or the like may be measured with the shoe in an inclined state of the toe being lowered.

The thus obtained wearing pressure data and gap data can be evaluated as the fitting of the shoe in a state approximating the state of the wearer while walking. Here, the measurement method for evaluating the fitting of the wearer during walking has been described, but the disclosure is not limited thereto, and the fitting of the shoe can be evaluated while reproducing various states of the wearer.

The evaluation method using a last can be used, for example, in the following situations.

For example, for a shoe that has already been commercialized, whether the shoe has appropriate fitting can be evaluated by measuring a wearing pressure or the like of the shoe using the last. Furthermore, a shoe having an appropriate fitting property can be manufactured by measuring a wearing pressure or the like using the last with respect to a shoe to be commercialized.

For example, when there is a shoe that has a reputation as having good fitting among shoes distributed in the market, a wearing pressure or the like of the shoe is measured using the last. As a result, a range of the wearing pressure data of the shoe having good fitting is determined. This wearing pressure data is utilized for the manufacture of the shoe to be commercialized.

Note that, in the above description, the evaluation method using the last having the variable portion and/or the load application unit has been described, but for example, the last may be worn on the foot of the wearer, the shoe may be worn in a state where the last is worn, and the wearing pressure and/or the gap may be measured as described above.

Figure 29:
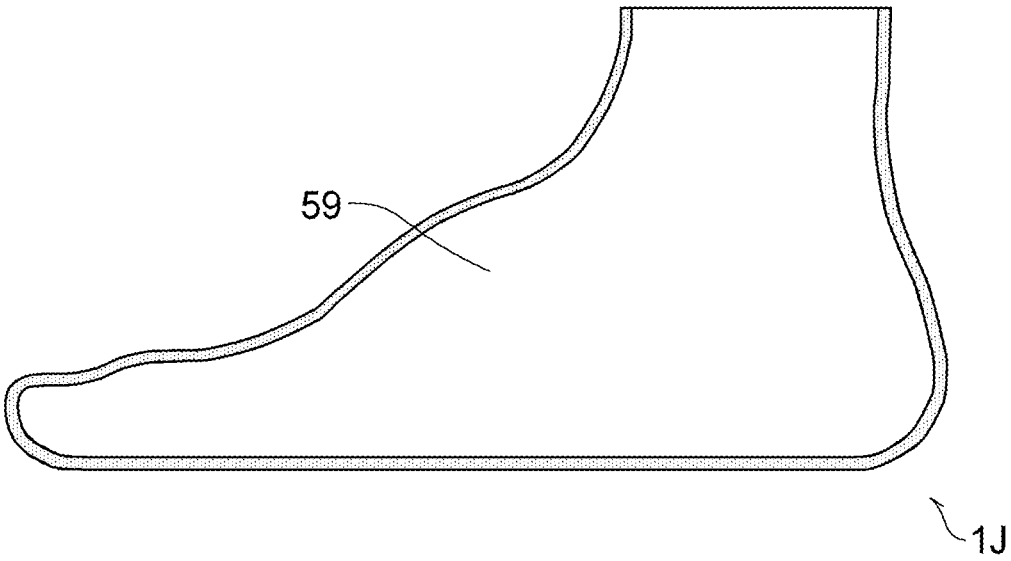
FIG. 29 is a cross-sectional view illustrating a last of Example 10 that can be worn on a person's foot.

FIG. 29 is a cross-sectional view of a last 1J into which a wearer's foot can be inserted, divided in the front-to-rear direction. Note that, although the last 1J is provided with a pressure measurement unit and a gap measurement unit, these units are not illustrated in FIG. 29. A cavity portion 59 into which the wearer's foot can be inserted is formed inside the last 1J. The foot is inserted into the cavity portion 59, and the wearer wears the shoe with the last 1J worn thereon. Then, the wearer performs various activities, and the wearing pressure or the like is measured in these states. According to such a measurement method, since the wearer actually wears the last 1J, the fitting of the shoe can be appropriately evaluated.

Note that a foot of a mannequin may be inserted into the last 1J illustrated in FIG. 29, the last may be inserted into the shoe, and the wearing pressure or the like may be measured while the mannequin is manipulated.

DESCRIPTION OF EMBODIMENTS

The disclosure includes the following embodiments.

A measurement device according to a first embodiment includes a last insertable into a shoe; a pressure measurement unit configured to measure a wearing pressure on an top surface of a foot of the last in a state where the last is inserted into the shoe; and a gap measurement unit configured to measure at least one of a gap between a front end portion of the last and an inner front end portion of the shoe and a gap between a rear end portion of the last and an inner rear end portion of the shoe, in which the last includes a main body portion and a variable portion, and at least one selected from a shape of the variable portion, a weight of the variable portion, and a position of the variable portion with respect to the main body portion is changeable.

By using the measurement device of the first embodiment, not only a fitting of a shoe when a wearer actually wears the shoe and is standing posture, but also a fitting of the shoe when the wearer is active can be appropriately evaluated.

In a measurement device according to a second embodiment, the shape of the variable portion of the measurement device according to the first embodiment is changeable, and the variable portion is disposed in at least one place selected from a front portion of the last, a side portion of the last, a rear portion of the last, an arch of the foot portion of the last, and an instep portion of the last.

In a measurement device according to a third embodiment, the position of the variable portion with respect to the main body portion of the measurement device according to the first or second embodiment is changeable, the variable portion is disposed in at least one of an ankle portion of the last and a front portion of the last, and an angle or a distance of the variable portion with respect to the main body portion is changeable.

In a measurement device according to a forth embodiment, the weight of the variable portion of the measurement device according to any one of the first embodiment to the third embodiment, and the weight of the variable portion is changeable by changing to a constituent member having a different weight.

In a measurement device according to a fifth embodiment, the weight of the variable portion of the measurement device according to any one of the first embodiment to the third embodiment is changeable, and the variable portion has a weight holding portion that holds a weight, and the weight of the variable portion is changeable by making the weight holding portion hold the weight.

A measurement device according to a sixth embodiment further includes a load application unit configured to apply a load to the last in the measurement device according to any one of the first embodiment to the fifth embodiment.

In a measurement device according to a seventh embodiment, the load application unit of the measurement device according to the sixth embodiment includes a unit configured to measure a wearing pressure on a bottom surface of the foot of the last, and the load application unit is configured to be able to apply a load to the last so as to be able to change a site where the wearing pressure on the bottom surface of the foot of the last becomes a maximum value from a first site of the last to a second site of the last.

A measurement device according to an eighth embodiment corresponds to the measurement device according to the seventh embodiment, in which at least one of a shape of the variable portion of the last and a position of the variable portion of the last with respect to the main body portion is changeable as the site where the wearing pressure on the bottom surface of the foot of the last becomes the maximum value is changed by the load application unit.

What is claimed is:

1. A measurement device for shoe fitting evaluation comprising:

a last insertable into a shoe, a top surface of a foot of the last being a surface region configured to be in contact with an upper inner surface of the shoe with the last inserted into the shoe;

a pressure measurement unit configured to measure a wearing pressure applied on the top surface of the foot of the last from an upper of the shoe in a state where the last is inserted into the shoe; and a gap measurement unit configured to measure at least one of a gap between a front end portion of the last and an inner front end portion of the shoe and a gap between a rear end portion of the last and an inner rear end portion of the shoe, wherein the last comprises a main body portion including a heel portion of the last and a position variable portion including an ankle portion, a position of the position variable portion with respect to the main body portion is changeable, the position variable portion is configured to be fixed at different set positions with respect to the main body, and the pressure measurement unit is configured to measure the wearing pressure applied on the top surface of the foot of the last at the different set positions of the position variable portion with respect to the main body in a state where the shoe is worn by the last.

2. The measurement device for shoe fitting evaluation according to claim 1, wherein the position variable portion includes a front portion of the last, an angle of each of the ankle portion and the front portion with respect to the main body portion is changeable, and each of the ankle portion and the front portion is configured to be fixed at a changed angle.

3. The measurement device for shoe fitting evaluation according to claim 1, wherein the pressure measurement unit has a pressure sensor disposed on the top surface of the foot of the last.

4. The measurement device for shoe fitting evaluation according to claim 1, wherein the position variable portion is configured to be fixed at the different set portions with respect to the main body via a gear, a pawl, or a ratchet mechanism.

5. The measurement device for shoe fitting evaluation according to claim 1, further comprising a bottom surface pressure measurement unit that has a plurality of pressure sensors, wherein the plurality of pressure sensors are provided on a bottom surface of the foot of the last at a toe, a tread, an arch, and a heel.

* * * * *